US012290189B2

(12) United States Patent
Zhong

(10) Patent No.: US 12,290,189 B2
(45) Date of Patent: May 6, 2025

(54) ORNAMENT CAROUSEL HOLDER

(71) Applicant: Shenzhen IVAN Houshold Supply Co., Ltd., ShenZhen (CN)

(72) Inventor: Xiao Ting Zhong, Shenzhen (CN)

(73) Assignee: Shenzhen IVAN Houshold Supply Co., Ltd., Shenzhen (CN)

( * ) Notice: Subject to any disclaimer, the term of this patent is extended or adjusted under 35 U.S.C. 154(b) by 0 days.

(21) Appl. No.: 18/232,818

(22) Filed: Aug. 10, 2023

(65) Prior Publication Data

US 2024/0382018 A1 Nov. 21, 2024

(30) Foreign Application Priority Data

May 19, 2023 (CN) ..... 202321237024.X

(51) Int. Cl.

| | |
|---|---|
| ***A47F 5/02*** | (2006.01) |
| ***A47B 49/00*** | (2006.01) |
| ***A47F 5/00*** | (2006.01) |
| ***A47F 5/13*** | (2006.01) |
| ***A47F 7/02*** | (2006.01) |

(52) U.S. Cl.

CPC ..... *A47F 5/02* (2013.01); *A47B 49/004* (2013.01); *A47F 5/0006* (2013.01); *A47F 5/13* (2013.01); *A47F 7/02* (2013.01)

(58) Field of Classification Search

CPC .. A47F 5/02; A47F 5/0006; A47F 5/13; A47F 3/10; A47F 5/025; A47F 7/02; A47B 49/00; A47B 49/004; A47B 49/008; A47B 2065/005

USPC ..... 211/163, 85.2

See application file for complete search history.

(56) References Cited

U.S. PATENT DOCUMENTS

| | | | | | |
|---|---|---|---|---|---|
| 3,693,807 | A * | 9/1972 | Larson | A47F 3/10 | 211/163 |
| 4,093,077 | A * | 6/1978 | Strasser | A47F 5/13 | 211/85.2 |
| 4,126,366 | A * | 11/1978 | Handler | B25H 3/00 | 211/163 |
| 4,322,007 | A * | 3/1982 | Feibelman | A47F 7/02 | 211/85.2 |
| 4,392,628 | A * | 7/1983 | Hadfield | A47B 49/004 | 211/144 |
| 4,614,272 | A * | 9/1986 | Shelton | A47F 7/021 | 211/163 |
| 4,767,011 | A * | 8/1988 | Butler | A47F 7/02 | 211/85.2 |
| 4,850,658 | A * | 7/1989 | Sandor | A47F 5/02 | 211/85.2 |
| 4,905,821 | A * | 3/1990 | Corbett | A47G 1/12 | 211/85.2 |
| 5,050,745 | A * | 9/1991 | Sanders | A45C 11/16 | 211/85.2 |

(Continued)

FOREIGN PATENT DOCUMENTS

CN 219982592 U * 11/2023

*Primary Examiner* — Jennifer E. Novosad

(74) *Attorney, Agent, or Firm* — Ying-Ting Chen

(57) ABSTRACT

An ornament carousel holder includes a stand body, a turntable which is mounted on the turntable and is capable of being drive to rotate 360° on the turntable, and a hanging assembly connected to the stand body for hanging ornaments such as jewelries, necklaces, bracelets, earrings, danglings, studs, and hoops.

10 Claims, 20 Drawing Sheets

(56) References Cited

U.S. PATENT DOCUMENTS 5,052,563 A * 10/1991 Camp ..... A47F 7/02 211/85.2
5,054,624 A * 10/1991 Camp ..... A47F 5/02 211/85.2
5,087,105 A * 2/1992 White ..... A47F 7/02 211/85.2
5,176,263 A * 1/1993 Caruso ..... A47F 7/02 211/85.2
5,257,703 A * 11/1993 Ascik ..... A47F 5/02 211/208
D353,065 S * 12/1994 Greenlee ..... D6/552
5,499,726 A * 3/1996 Mitchell ..... A47F 5/16 211/85.2
5,678,908 A * 10/1997 Wang ..... A47B 81/00 312/285
5,794,782 A * 8/1998 Ascik ..... A47F 11/04 206/730
5,853,090 A * 12/1998 Brozak, Jr. ..... A47F 5/0846 211/13.1
5,950,815 A * 9/1999 Yetman-Bellows ... A47G 1/143 211/85.2
6,102,216 A * 8/2000 Frank ..... A47B 61/00 211/85.2
6,425,647 B1 * 7/2002 Pothin ..... A47F 7/02 312/249.4
6,443,317 B1 * 9/2002 Brozak, Jr. ..... A47F 7/021 211/85.1
7,793,793 B1 * 9/2010 Sykes ..... A47F 5/13 211/85.2
7,891,506 B2 * 2/2011 Kornowski ..... A47F 7/02 211/85.2
D655,533 S * 3/2012 Denby ..... D6/680
8,342,343 B2 * 1/2013 Shea ..... A47F 5/0018 211/163
8,534,472 B2 * 9/2013 Levine ..... A47F 5/04 211/163
11,259,654 B1 * 3/2022 Padula ..... A47F 5/0815
D965,363 S * 10/2022 Cheng ..... D6/682.4
11,596,245 B1 * 3/2023 Cheng ..... A47F 5/10
11,672,337 B1 * 6/2023 Clayton ..... A47B 49/004 312/202
11,839,297 B2 * 12/2023 Rehage ..... A47B 17/065
2024/0382018 A1 * 11/2024 Zhong ..... A47F 5/02

* cited by examiner

ORNAMENT CAROUSEL HOLDER

CROSS REFERENCE OF RELATED APPLICATION

This application is a non-provisional application that claims priority under 35 U.S.C. § 119 to China application number CN202321237024.X, filing date May 19, 2023, wherein the entire content of which is expressly incorporated herein by reference.

BACKGROUND OF THE PRESENT INVENTION

Field of Invention

The present invention relates to an ornament holding arrangement, and more particularly to an ornament carousel holder.

Description of Related Arts

An ornament supporting rack is often used in an ornament displaying occasion, in an ornament selling counter, or at home for storing various ornaments of the user. A good ornament supporting rack is particularly important for the displaying performance of the ornaments, it not only needs to consider aesthetics, but also stability and storage function. However, most conventional racks can only support ornaments on a predetermined side, they often have fewer places to place ornamental items and thus there is insufficient storage capacity. On the other hand, although some conventional ornament supporting racks can rotate, after placing the ornaments, there is a situation of top-heavy and unstable during the rotation process. In other words, the conventional ornament supporting racks are prone to tip over and result in damage to the ornament, causing unacceptable consequences for the user.

In addition, for the placement of ornaments, especially earrings, it also needs to be convenient to pick up. For example, since there are plugs for positioning the ear studs, the conventional supporting racks only allow the user to take the ear studs from the front side, and cannot reach behind the ear studs to have access to the plugs, and thus this is very inconvenient for the user. If forcibly taken, it will damage the ear studs. Moreover, it is a waste of time when it is difficult to get the plugs. If this inconvenient situation occurs at an exhibition or in a shopping mall, it will give customers a negative impression.

Therefore, there is an urgent need to improve the conventional ornament supporting and displaying racks to better meet the user's requirements.

SUMMARY OF THE PRESENT INVENTION

The invention is advantageous in that it provides an ornament carousel holder which is able to rotate freely and stably support various ornaments such as jewelries, necklaces, bracelets, earrings, danglings, studs, and hoops.

Another advantage of the present invention is to provide an ornament carousel holder which is able to rotate 360° with a steady center of gravity, and can still stand firmly on a bottom ground surface or on a desktop after hanging the ornaments, so as to effectively avoid the occurrence of rollover during the rotation process.

Another advantage of the present invention is to provide an ornament carousel holder, wherein four sides of the ornament carousel holder can be freely arranged with ornaments, so as to provide more places and room for hanging the ornaments, perform a good storage effect, and can display the ornaments hung on any side through rotation, thereby meeting the diverse needs of the user.

Another advantage of the present invention is to provide an ornament carousel holder, wherein a center of the ornament carousel holder is defines with a central passage, which is convenient for the user to reach behind the ornaments such as the ear studs and take the plugs for the ear studs, making it convenient to take and place the ornaments.

Another advantage of the present invention is to provide an ornament carousel holder which is diversified in functions, compact and sturdy in structure, occupies less space, is easy to carry and transport, and is suitable for various occasions.

Another advantage of the present invention is to provide an ornament carousel holder, wherein the placing positions for hanging ornaments of the ornament carousel holder is designed reasonably, and the hanging spacing and hanging positions can be adjusted, so that the multiple rows of ornaments will not be interfering with each other, so as to ensure a good displaying performance.

Another advantage of the present invention is to provide an ornament carousel holder, wherein a stand body of the ornament carousel holder is made of wood, one or more hanging holders are made of metal material, and one or more connecting elements are configured as circular protrusions made of elastic material, so that an overall beautiful appearance is provided.

According to the present invention, the foregoing and other objects and advantages are attained by an ornament carousel holder, comprising:

- a stand body;
- a turntable, wherein the stand body is mounted on the turntable and is capable of being drive to rotate on the turntable; and
- a hanging assembly connected to the stand body for hanging ornaments.

According to an embodiment, the stand body comprises a supporting base and a plurality of supporting frames upwardly and spacedly extended from the supporting base, wherein the supporting base is mounted on the turntable and is rotatable on the turntable, so as to drive the plurality of supporting frames and the hanging assembly to rotate.

According to an embodiment, the turntable comprises a supporting seat and a rotation driving assembly mounted on the supporting seat, wherein the rotation driving assembly comprises a bottom frame fixed to the supporting seat and a top rotation disc rotatably mounted to the bottom frame, wherein the stand body is mounted on the top rotation disc so as to rotate along with the top rotation disc.

According to an embodiment, the turntable comprises a supporting seat and a rotation driving assembly mounted on the supporting seat, wherein the rotation driving assembly comprises a bottom frame fixed to the supporting seat and a top rotation disc rotatably mounted to the bottom frame, wherein the supporting base of the stand body is mounted on the top rotation disc so as to rotate along with the top rotation disc.

According to an embodiment, the stand body comprises two the supporting frames which are spacedly installed on the supporting base, wherein the hanging assembly comprises a plurality of hanging holders which are spacedly and parallelly extended between two the supporting frames.

According to an embodiment, the hanging assembly further comprises two hanging meshes mounted within two the supporting frames respectively, each of the two hanging meshes comprises a plurality of mesh wires which is crossly interconnected to form a plurality of mesh holes for hanging the ornaments.

According to an embodiment, the supporting seat has a first central hole, the rotation driving assembly has a second central hole to be aligned with the first central hole.

According to an embodiment, the ornament carousel holder further comprises a plurality of second connecting members connecting the top rotation disc of the rotation driving assembly to the supporting base without protruding from a top surface of the supporting base, so as to provide a smooth top surface of the supporting base, wherein the supporting base is allowed to rotate 360°.

According to an embodiment, the turntable is mounted at a bottom of the supporting base in such a manner that a peripheral edge portion of the supporting base is outwardly protruded from the turntable, so as to allow the turntable to be hidden under the supporting base.

According to an embodiment, the ornament carousel holder comprises a plurality of third connecting members mounting the supporting base with two the supporting frames by penetrating the peripheral edge portion of the supporting base.

According to an embodiment, the stand body is made of wood, the supporting seat is made of wood, and the rotation driving assembly is made of metal.

According to an embodiment, the plurality of hanging holders is made of metal.

According to an embodiment, a weigh of the turntable and the supporting base of the stand body is larger than a weight of two the supporting frames and the hanging assembly.

According to an embodiment, the turntable is circular and the supporting base is rectangular.

According to an embodiment, each of the plurality of hanging holders comprises a connecting bar and has a plurality of hanging grooves indented at the connecting bar and a plurality of hanging holes formed in the connecting bar.

According to an embodiment, an access passage is formed within the stand body and the hanging assembly.

According to an embodiment, an access passage is surrounded and formed by two the supporting frames and the plurality of hanging holders.

According to an embodiment, the stand body and the hanging assembly are connected to form four ornament hanging sides, wherein an access passage is defined within the four ornament hanging sides, wherein each of the four ornament hanging sides is provided with a plurality of hanging holders with a plurality of hanging grooves and a plurality of hanging holes or a hanging mesh comprising a plurality of mesh wires which is crossly interconnected to form a plurality of mesh holes.

According to an embodiment, one of the four ornament hanging sides comprises five hanging holders which is made of metal, wherein the stand body is made of wood and comprises a supporting base and two supporting frame vertically extended from the supporting base, wherein the five hanging holders, which are spacedly extended between the two supporting frames, from bottom to top, comprise a first hanging holder, a second hanging holder, a third hanging holder, a fourth hanging holder and a fifth hanging holder, wherein the first hanging holder is connected between the two supporting frames at a height of 3.15 inches above the supporting base, an interval between the first hanging holder and the second hanging holder is 1.37 inches, an interval between the second hanging holder and the third hanging holder is 2.56 inches, an interval between the third hanging holder and the fourth hanging holder is 2.17 inches, an interval between the fourth hanging holder and the fifth hanging holder which is provided on a top side of the stand body is 0.6 inches.

According to an embodiment, a weigh of the turntable and the supporting base is 480 g, wherein a weigh of the two supporting frame and the hanging assembly is 400 g.

According to another aspect of the present invention, the present invention provides an ornament carousel holder, comprising:

a stand body, wherein the stand body comprises a supporting base and at least one supporting frame which is supported on the supporting base;

turntable, wherein the supporting base is connected to the turntable and is rotatable on the turntable; and a hanging assembly, wherein the hanging assembly is connected to the supporting frame and to form four hanging sides for hanging ornaments, wherein an access passage is formed within the supporting frame for a hand entering the access passage to operate backs of the ornaments.

According to an embodiment, the hanging assembly comprises four hanging meshes, each of the four sides of the hanging meshes is connected within the corresponding frame, and the hanging meshes connected to the frame to form four hanging sides of the stand body, and the central passage is formed between the four hanging meshes.

According to an embodiment, the hanging assembly comprises a plurality of hanging holders and two hanging meshes, the plurality of hanging holders is alternately connected to at least two supporting frames to form two opposite hanging sides of the stand body, and the four sides of each of the hanging meshes are connected within the corresponding supporting frames to form another two opposite hanging sides of the stand body.

According to an embodiment, the hanging assembly comprises a plurality of hanging holders which is alternately arranged at the at least two supporting frames to form four hanging sides of the stand body.

According to an embodiment, the stand body further comprises a plurality of connecting elements which is alternately arranged on the at least two supporting frames, wherein the hanging assembly comprises a plurality of hanging holders, and the hanging holders are detachably connected to the at least two supporting frames through the connecting elements. By connecting the hanging holders to different connecting elements, the spacing of the hanging holders can be changed to adjust the hanging positions of the ornaments.

According to an embodiment, each of the connecting elements has a predetermined elasticity, and the two ends of the hanging holder have connecting holes, each connecting element is compressed and enters the connecting hole to detachably connect the hanging holder to the corresponding supporting frame.

According to an embodiment, the hanging mesh comprises a plurality of mesh wires connected to each other form a plurality of mesh holes for hanging the ornaments.

According to an embodiment, each hanging holder comprises a connecting bar and has a plurality of hanging grooves and a plurality of hanging holes, wherein two ends of the connecting bar are connected to two supporting frames, and the hanging grooves and hanging holes are alternately arranged at the connecting bar.

According to an embodiment, the turntable is circular, and a weight of the turntable and the supporting base is greater than a sum of a weight of the supporting frames, the hanging assembly, and the ornaments hanging on the hanging assembly.

According to an embodiment, the supporting frame, the access passage, and the supporting base are all rectangular, the supporting frame is 30 cm high and 18 cm wide, and the side length of the supporting base is 18 cm and the thickness is 1.5 cm. The stand body of the rack is made of wood, the rotation driving assembly is made of metal.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
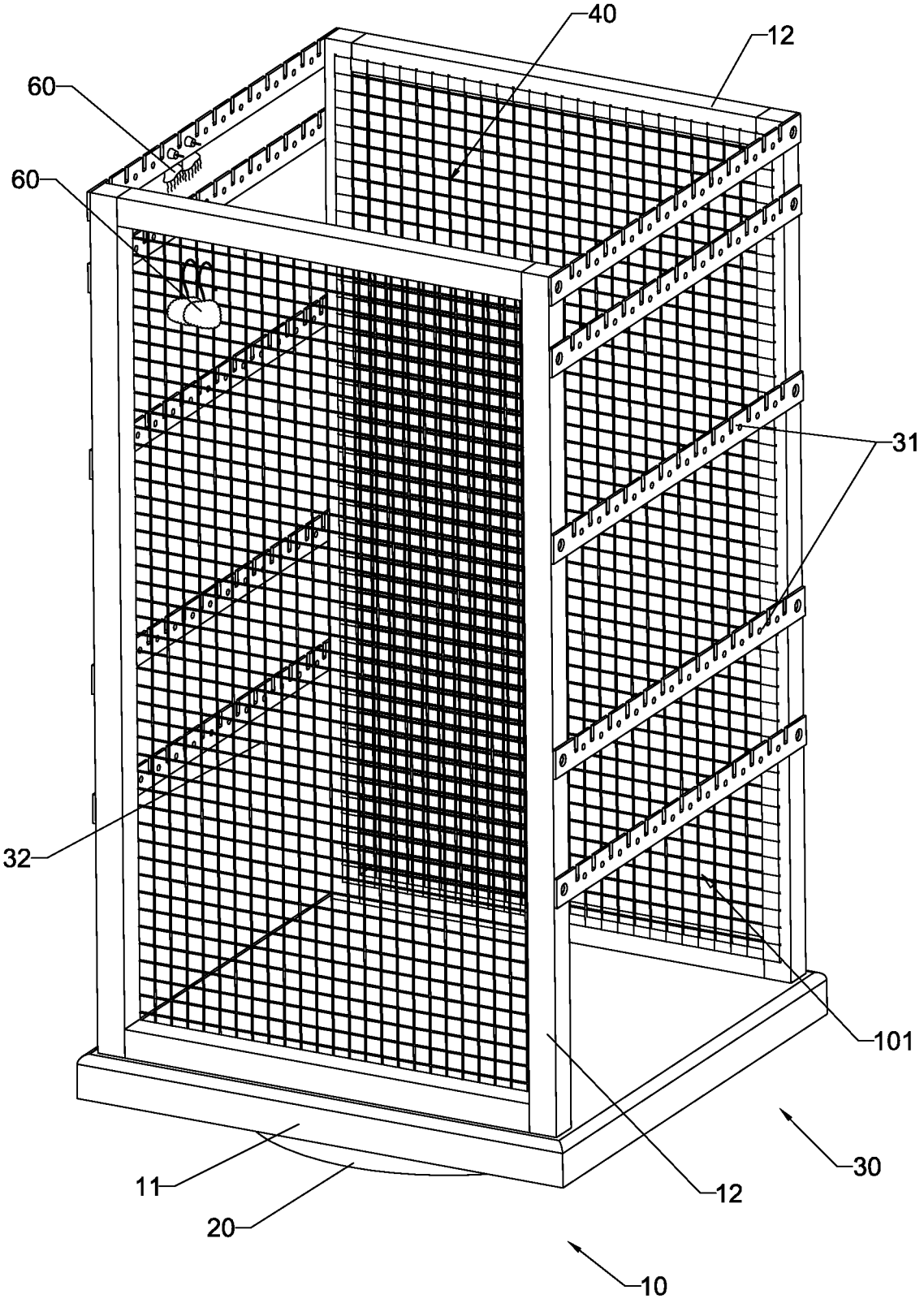
FIG. 1 is a perspective view of an ornament carousel holder according to a first preferred embodiment of the present invention.
Figure 2:
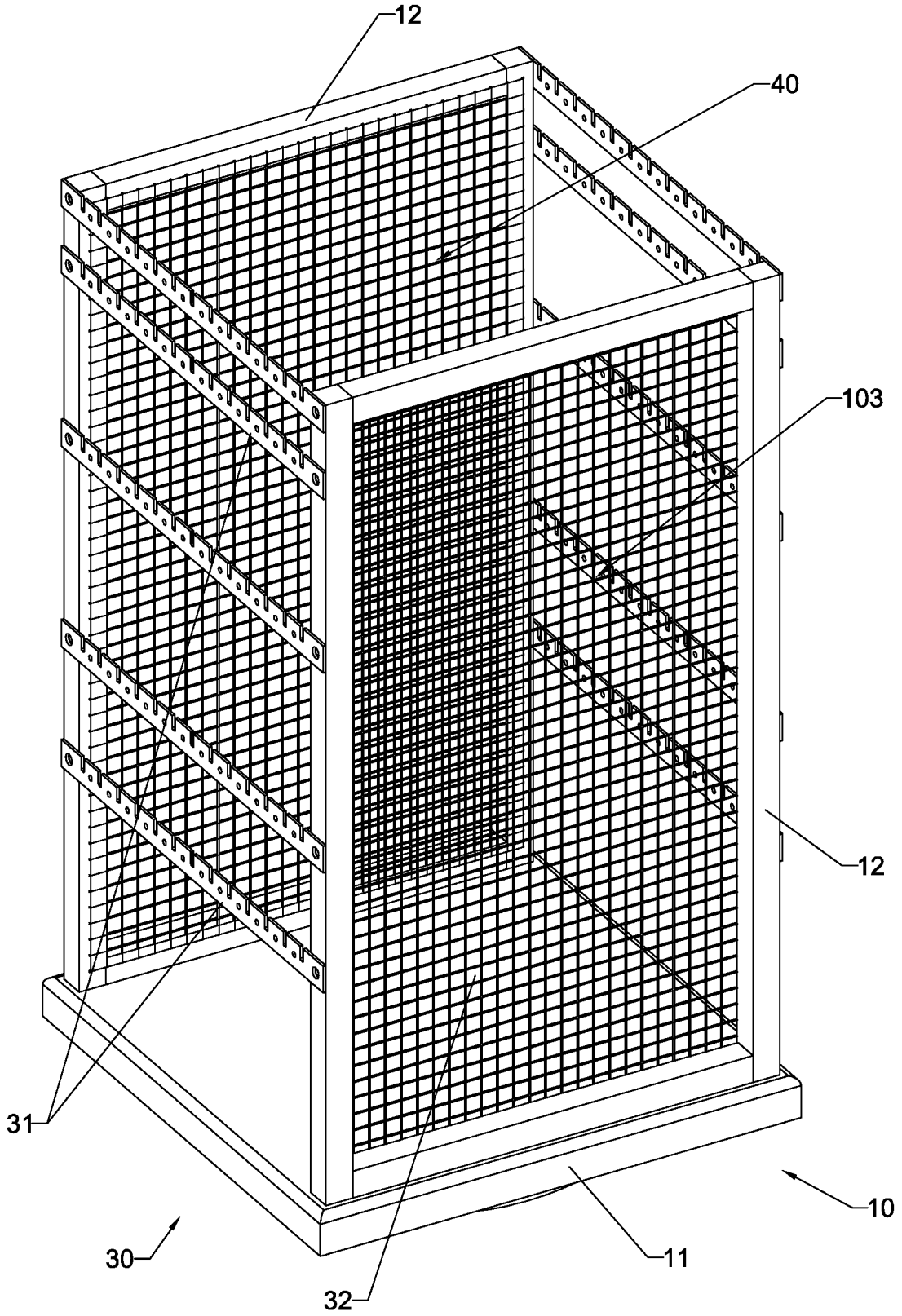
FIG. 2 is another perspective view of the ornament carousel holder according to the above first preferred embodiment of the present invention.
Figure 3:
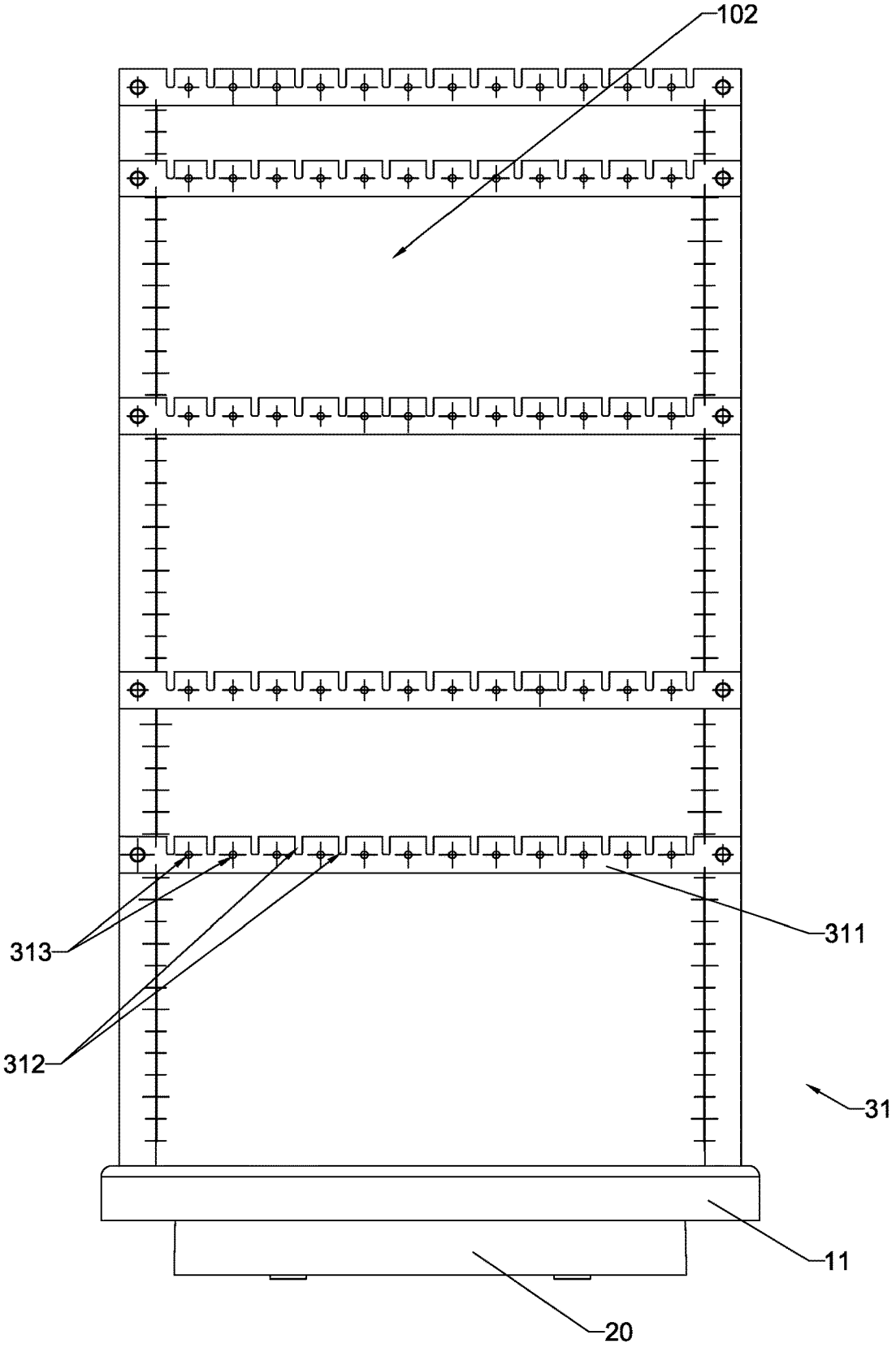
FIG. 3 is a sectional view illustrating an ornament hanging side of the ornament carousel holder according to the above first preferred embodiment of the present invention.
Figure 4:
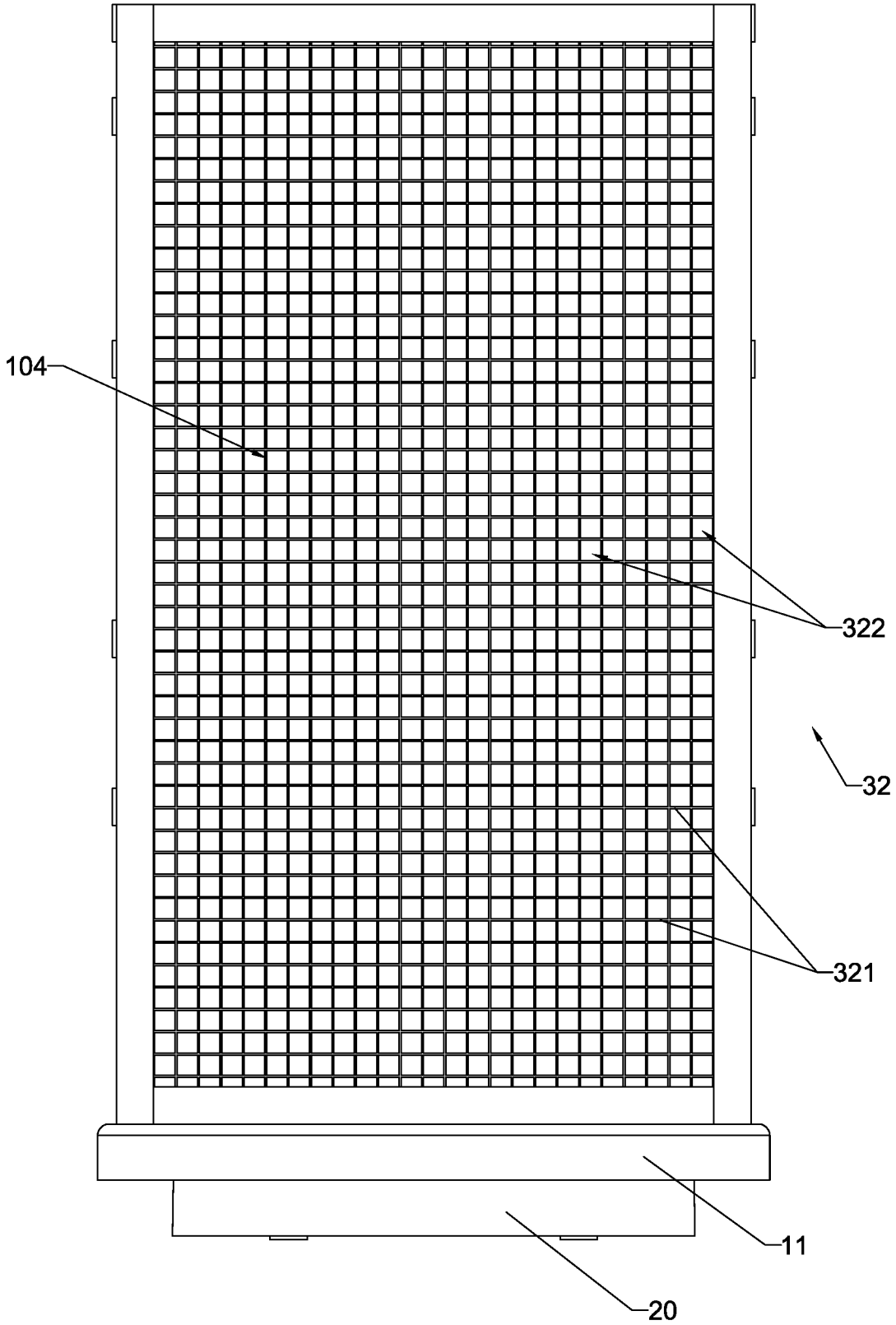
FIG. 4 is a sectional view illustrating another ornament hanging side of the ornament carousel holder according to the above first preferred embodiment of the present invention.
Figure 5:
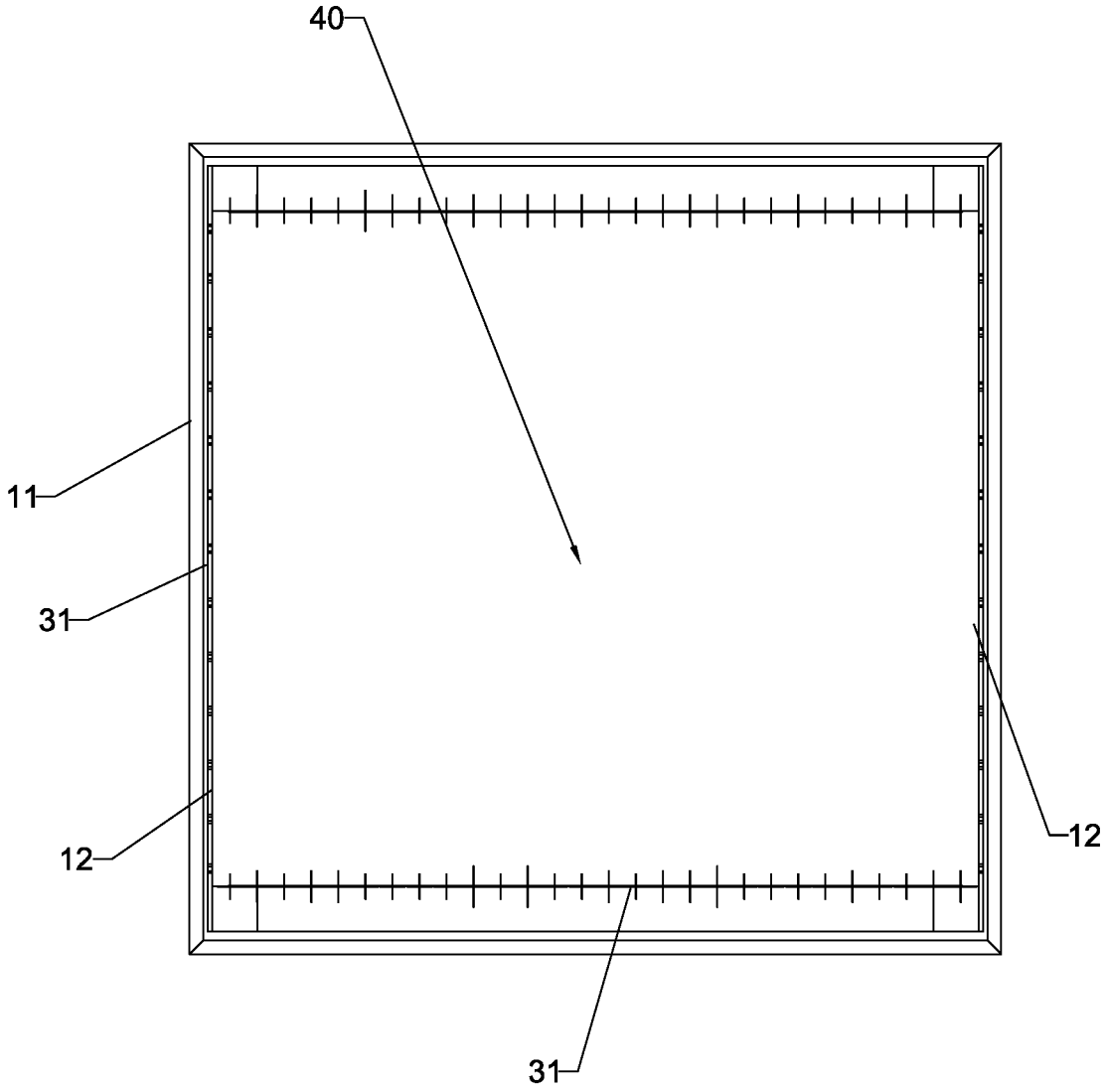
FIG. 5 is a top view of the ornament carousel holder according to the above first preferred embodiment of the present invention.
Figure 6:
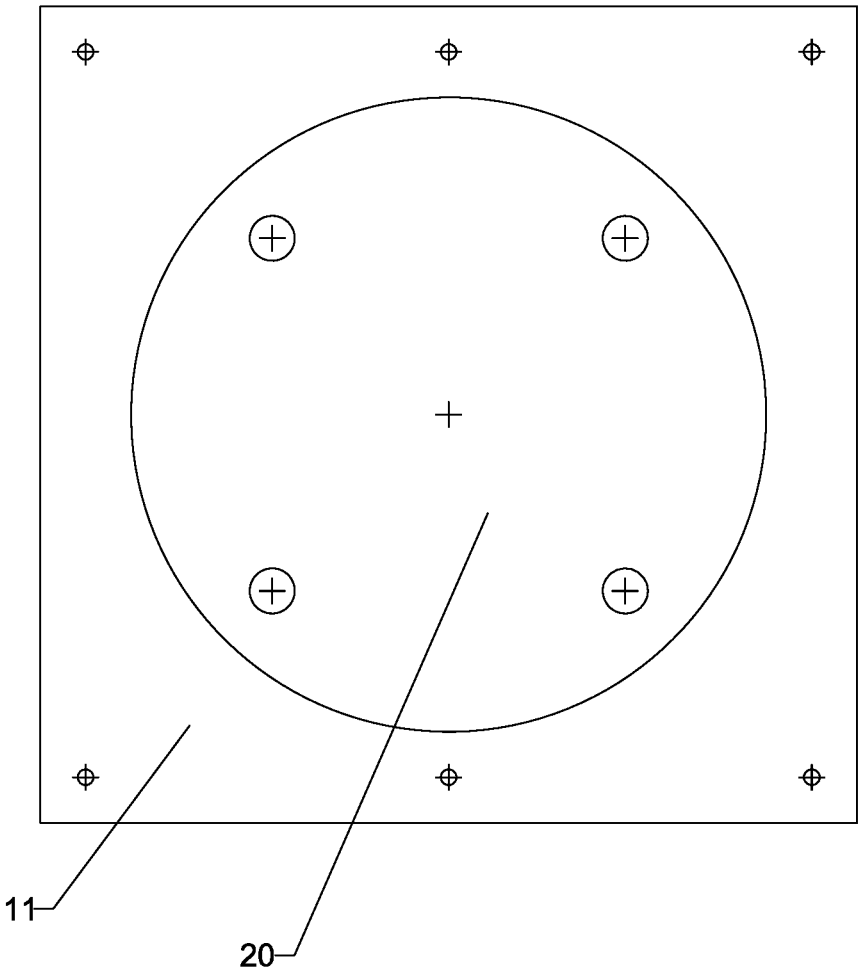
FIG. 6 is a bottom view of the ornament carousel holder according to the above first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right." "perpendicular." "horizontal," "top." "bottom," "inner." "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

It can be understood that the term "a" or "an" should be understood as "at least one" or "one or more", that is, in one embodiment, the quantity of a component can be one, while in another embodiment, the quantity of the component can be multiple. The term "a" or "an" should not be understood as a limitation on quantity.

Referring to FIGS. 1 to 6, an ornament carousel holder according to a first preferred embodiment of the present invention is illustrated. The ornament carousel holder comprises a stand body 10, a turntable 20, a hanging assembly 30, and has an access passage 40. The stand body 10 is installed on top of the turntable 20 and can be driven to rotate on the turntable 20, the hanging assembly 30 is installed on the stand body 10 for hanging one or more ornaments 60, the access passage 40 is formed inside the stand body 10, and the hanging assembly 30 is provided around the access passage 40. A user can place or retrieve the ornaments 60 by a hand in front of the ornament carousel holder, or the user's hand may reach into the access passage 40 to retrieve an accessory at a back side of the ornaments 60 hanging on the hanging assembly 30 or to manipulate and adjust the position of the accessory.

The stand body 10 comprises a supporting base 11 and at least one supporting frame 12. The supporting base 11 is rotatably connected on top of the turntable 20. The supporting frame 12 is extended along a circumferential direction and is perpendicular to the supporting base 11. By applying an external force to the supporting frame 12, the supporting base 11 can be driven by the turntable 20 to rotate 360° above the turntable 20, thereby presenting any side of four sides of the stand body 10 according to the user's requirement and ensuring a good displaying performance.

In this embodiment, the stand body 10 comprises four sides, i.e. a front hanging side 101, a back hanging side 102, a left hanging side 103, and a right hanging side 104. Among them, the front and back side surfaces 101 and 102 are opposite to each other, and the left and right hanging side surfaces 103 and 104 are opposite to each other. After the four sides of the stand body 10 are connected, a access passage 40 is formed in the middle.

In this embodiment, two supporting frames 12 are respectively connected to the supporting base 11 at the front hanging side 101 and the back hanging side 102. Each supporting frame 12 has a rectangle shape and is made of the same material as the supporting base 11. In this embodiment, it is a wooden structure which is aesthetically pleasing and suitable for various occasions such as exhibitions, ornament displaying in shopping malls, and storage of ornaments, jewelries, or earrings in stores or at home.

In this embodiment, the hanging assembly 30 comprises a plurality of hanging holders 31 and two hanging meshes 32 on the supporting frames 12 to hang the ornaments 60.

In this embodiment, the hanging holders 31 are implemented as metal crossbars which are spacedly arranged between the two supporting frames 12 and are connected to the two frames 12 to increase the stability of the supporting frames 12.

In this embodiment, preferably, one of the hanging holders 31 is set at a top side of the two supporting frames 12, i.e. two ends of the hanging holder 31 are connected to the top side of the supporting frames 12, so as to connect the two supporting frames 12 from the top and increase stability.

Multiple other hanging holders 31 can be connected at intervals between the two supporting frames 12, so as to connect the two supporting frames 12 from top to bottom at intervals and increase the stability of the two supporting frames 12, and form multiple holding arms for hanging the ornaments 60, so that the left hanging side 103 and the right hanging side 104 of the stand body 10 are configured by the hanging holders 31, and the ornaments 60 can be hung on the left hanging side 103 and the right hanging side 104 of the stand body 10 by the hanging holders 31.

Each hanging holder 31 comprises a connecting bar 311, and has a plurality of hanging grooves 312 and a plurality of circular hanging holes 313. The plurality of hanging grooves 312 is alternately arranged in an upper part of the connecting bar 311, and the plurality of hanging holes 313 are alternately arranged in the lower part of the connecting bar 311. The positions of the hanging holes 313 is preferred to be in the same straight line as the bottoms of the hanging grooves 312. Due to the need to hang the ornaments 60 through the hanging grooves 312 and hanging holes 313, different structures can hang different styles of ornaments 60, so as to increase versatility. After the ornaments 60 are hung at the hanging holes 313 and the bottoms of the hanging grooves 312, the hanging positions of the ornaments 60 are in the same straight line, making it neat and more beautiful.

Two hanging meshes 32 are respectively provided on the two supporting frames 12, i.e. four sides of each hanging mesh 32 are connected to four sides of the corresponding supporting frame 12. The hanging mesh 32 and the corresponding supporting frame 12 form a planar structure. The ornaments 60 can be hung on the entire hanging mesh 32, and the supporting frame 12 supports the corresponding hanging mesh 32 and the ornaments, thereby ensuring stability.

The hanging mesh 32 comprises a plurality of mesh wires 321 and has a plurality of mesh holes 322. After the plurality of mesh wires are cross-connected, the plurality of mesh holes 322 is defined in a predetermined configuration. The ornaments 60 can be hung by the mesh wires 321 at the mesh holes 322, and the ornaments 60 can be hung in different mesh holes 322 according to the user's preference. Therefore, the ornaments 60 can be arranged in different positions on the same hanging mesh 32, making it convenient to hang, easy to adjust, and is time saving and labor saving, so that it is able to meet the different needs of the user.

After the hanging assembly 30 is arranged on the stand body 10, the hanging holders 31 are arranged at two opposite sides of the access passage 40. The two hanging meshes 32 and the two supporting frames 12 are arranged at the other two opposite sides of the access passage 40. The ornaments 60 can be hung on the hanging holders 31 and the hanging meshes 32 from the outside of the stand body 10. The hanging position of each ornament 60 can also be adjusted by reaching the hand of the user into the access passage 40. The access passage 40 can be used for hanging, fixing, moving, and removing the ornaments 60. In particular, for an ear stud, in order to prevent a plug from getting lost and ensure the stability of the hanging, the plug is often placed at the back of the hanging ear stud. When connecting or removing the plug, one can reach his or her hand into the access passage 40 and put on or remove the plug from the back of the ear stud while using the other hand to hold on the ear stud.

In this embodiment, due to the fact that the supporting frame 12 is rectangular, the access passage 40 can also be rectangular. Furthermore, the hanging holders 31 are connected at the outside of the supporting frames 12 between the two supporting frames 12, and each hanging mesh 32 is connected in the corresponding supporting frame 12, without occupying an internal space of the stand body 10. Therefore, the rectangular access passage 40 has a relative large space, making it easier to reach in and take the ornament accessory such as plugs behind the ear studs or perform other operations.

In this embodiment, each supporting frame 12 is rectangular, and the supporting base 11 is also rectangular. Each supporting frame 12, which is installed at two opposite edges of the supporting base 11, has a height of 30 cm and a width of 18 cm, and each hanging holder 31 also has a width of 18 cm matching the supporting frames 12 for aesthetic purposes. Particularly, the supporting base 11 has a square shape with a thickness of 1.5 cm and a side length of 18 cm, and is connected to the supporting frames 12 in a matching manner. While ensuring stability, each of the four sides of the supporting frames 12 has a thickness of 1 cm, which not only ensures aesthetics and saves materials, but also provides a relatively large space for the access passage 40.

The turntable 20 comprise a rotating disc which is installed on a bottom of the supporting base 11. The supporting base 11 is square, the turntable 20 is circular and arranged corresponding to a central area of the supporting base 11, so that the center of gravity of the entire ornament carousel holder is concentrated on the turntable 20, and a diameter of the turntable 20 is smaller than the side length of the supporting base 11 so as to hidden the turntable 20 under the supporting base 11. When the ornament carousel holder is placed on a desktop or on the ground, the turntable 20 has a contact with the desktop or the ground and supports the stand body 10 of the ornament carousel holder, and the supporting base 11 does not have contact with the desktop or ground. By controlling the thickness of the turntable 20, it can ensure that the stand body 10 of the ornament carousel holder can rotate smoothly and stably above the turntable 20, and the turntable 20 is not visible from the outside, which takes into account both aesthetics and practicality.

The turntable 20 has a predetermined weight and surface area, and can stably support the stand body 10 of the ornament carousel holder and the hanging ornaments 60. It can effectively prevent the tipping over of the ornament carousel holder during the rotation process.

Regarding the conventional display rack, it is prone to tip over during rotation. If a valuable ornament is hung on it, it can cause serious damage. However, in this invention, the ornament carousel holder increases the weight of the turntable 20 and adjusts the configuration of the turntable 20 and the stand body 10 of the ornament carousel holder and maintain a steady center of gravity, making it more stable and preventing tipping over, thus ensuring high safety.

Figure 7:
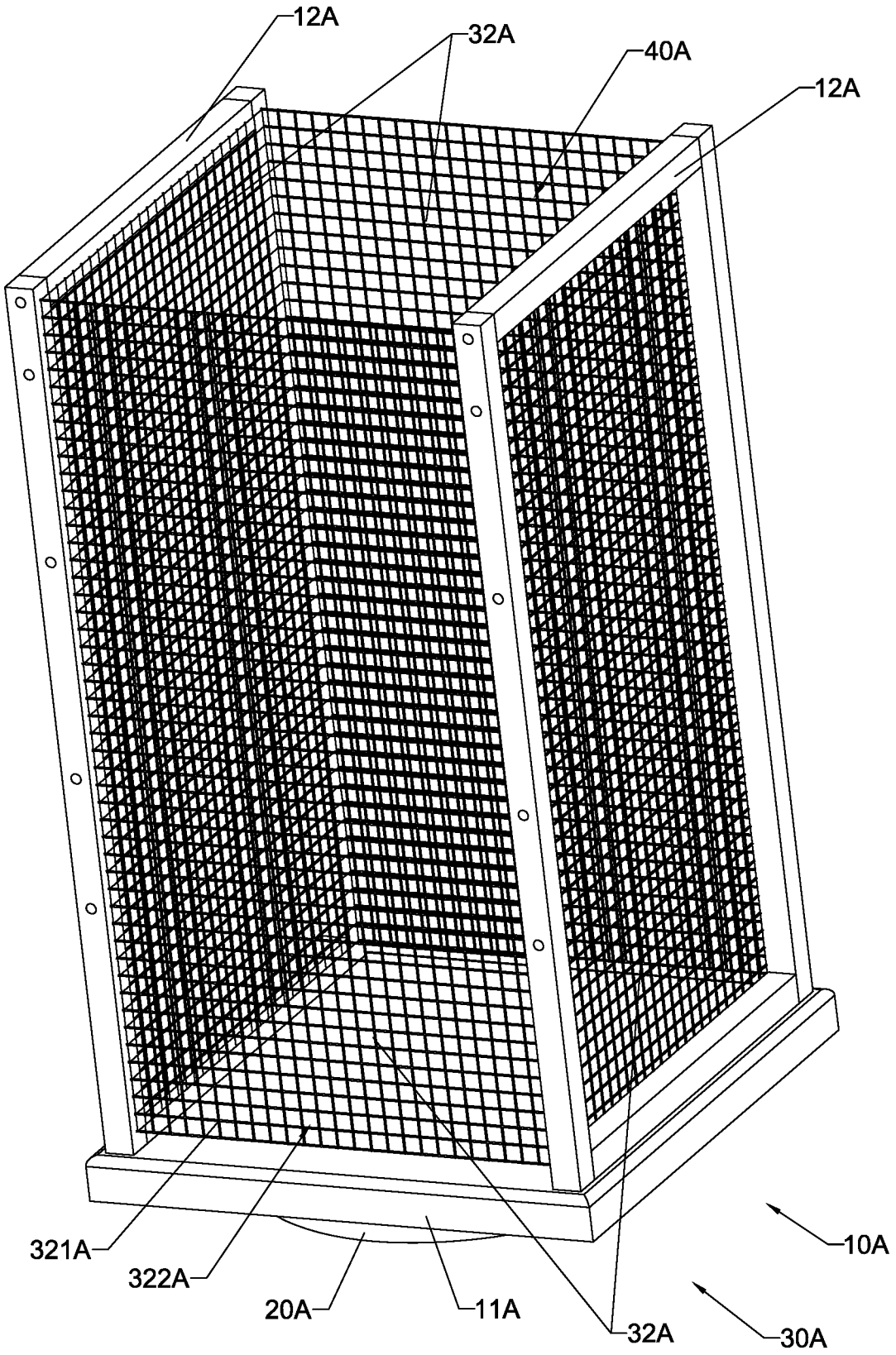
FIG. 7 is a perspective view of an ornament carousel holder according to a second preferred embodiment of the present invention.

Referring to FIG. 7, an ornament carousel holder according to a second preferred embodiment of the present invention is illustrated. In this embodiment, improvements are made to the supporting frames 12 and hanging assembly 30 of the above embodiment. Each supporting frame 12A is a wooden frame structure, and the hanging assembly 30A comprises four hanging meshes 32A connected to the two supporting frames 12A. After the connection, the hanging meshes 32A form four hanging sides of the stand body 10A of the ornament carousel holder.

Each hanging mesh 32A comprise a plurality of mesh wires 321A which is intersect to form a plurality of mesh holes 322A. The combination of the mesh wires 321A and the mesh holes 322A forms a hanging area for hanging the ornaments 60.

After the hanging meshes 32A are connected to the two supporting frames 12A, the four sides of the hanging mesh 32A are connected to the corresponding supporting frames 12A to form the access passage 40A. Due to the thinness of the two supporting frames 12A can be thin, and the hanging meshes 32A occupy a few space. Therefore, the access passage 40A has a relatively enough space, thereby making it more convenient to reach behind the ear studs on the hanging meshes 32A to take the plugs. During the process of taking, the larger space of the access passage 40A ensures that the hand does not touch other parts, enabling more accurate retrieval of the ornaments 60 from a specific position, which is beneficial for protecting other ornaments 60.

The turntable 20A comprises a rotating disc below the supporting base 11A, and has a predetermined proportional weight relationship with the supporting base 11A. Both the turntable 20A and the stand body 10A are configured to have predetermined weights, so as to enable the turntable 20A to stably support the stand body 10A. After hanging the ornaments 60, there will be no tipping over or other situations occurring during rotation.

Figure 8:
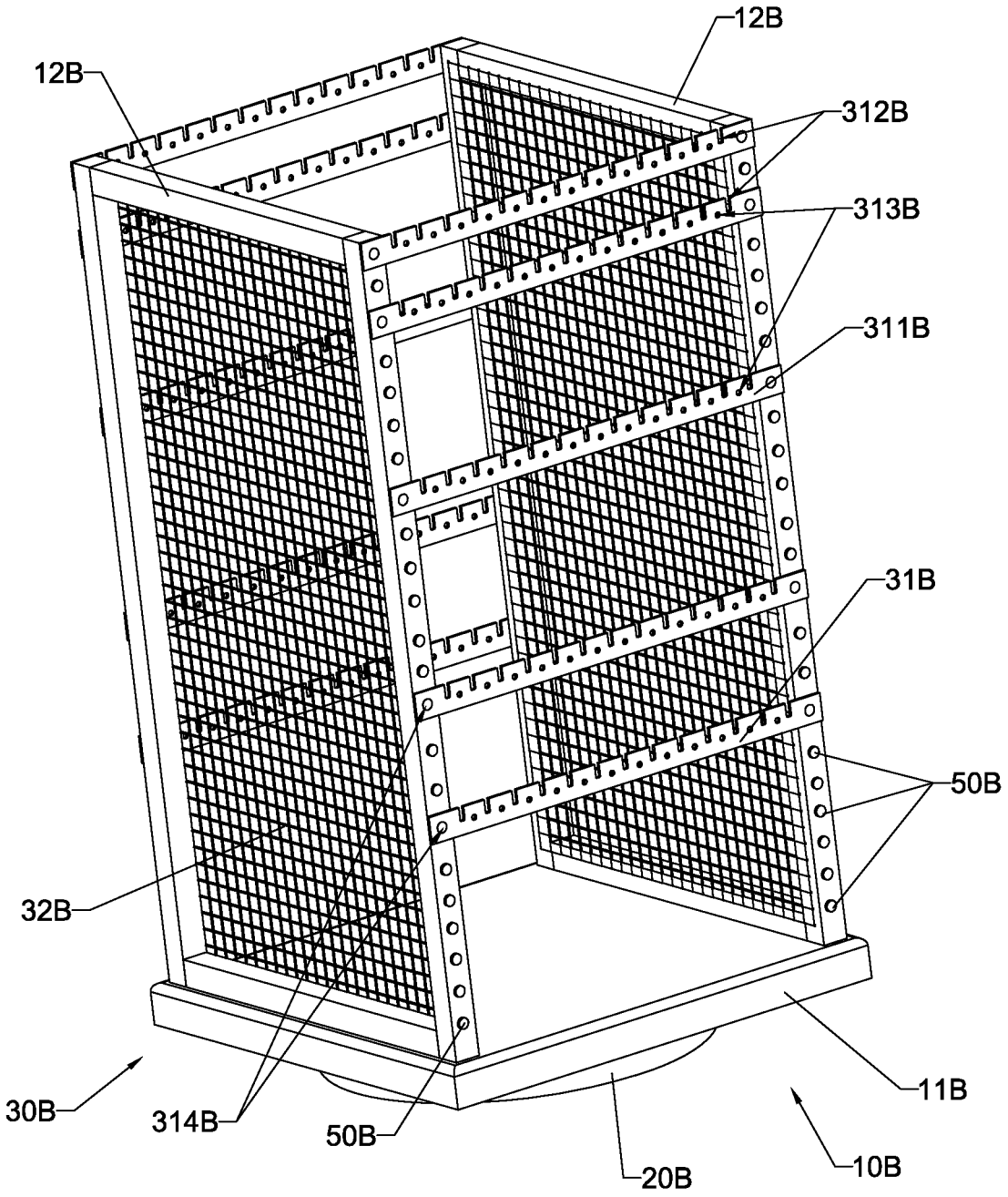
FIG. 8 is a perspective view of an ornament carousel holder according to a third preferred embodiment of the present invention.

Referring to FIG. 8, an ornament carousel holder according to a third preferred embodiment of the present invention is illustrated. In this embodiment, the ornament carousel holder comprises a stand body 10B and a turntable 20B, wherein the stand body 10B is rotatably connected on top of the turntable 20B. The turntable 20B is the same as the turntable 20 in the first embodiment mentioned above, and will not be described here.

The stand body 10B comprises a supporting base 11B and two supporting frames 12B each is extended upwardly and vertically from the supporting base 11B. The supporting base 11B is square, and each of the supporting frames 12B is rectangular.

The hanging assembly 30B comprises a plurality of hanging holders 31B and two hanging meshes 32B. The hanging holders 31B are alternately and detachably connected to the two supporting frames 12B to form the stand body 10B of the ornament carousel holder with two hanging sides. The four sides of the hanging mesh 32B are connected to the corresponding supporting frame 12B to position the hanging mesh 23B within the corresponding supporting frame 12B to form two other hanging sides of the stand body 10B of the ornament carousel holder.

Each hanging holder 31B comprises a connecting bar 311B, and has a plurality of hanging grooves 312B, a plurality of circular hanging holes 313B, and two connecting holes 314B which are respectively formed at two ends of the connecting bar 311B. The plurality of hanging grooves 312B and the plurality of connecting holes 314B are alternately arranged in the connecting bar 311B and located in the region between the two connecting holes 314B.

The stand body 10B further comprises a plurality of connecting elements 50B, which is alternately arranged on the outer side of the two supporting frames 12B. The connecting elements 50B match with the connecting holes 314B and are detachably connecting the supporting frames 12B with the connecting bars 311B through the connection between the connecting holes 314B and the connecting elements 50B.

Since each of the hanging holders 31B is connected to the outer side of the supporting frame 12B, the central channel 40B located inside the two supporting frames 12B has a relatively larger space, thereby making it easier to reach in and operate the hanging accessories.

The connecting elements 50B are spaced apart along the two supporting frames 12B, and the hanging holders 31B can be positioned at different locations on the supporting frames 12B by connecting to the connecting elements 50B at different positions with different heights, so as to allow the distance between the two hanging holders 31B to be adjusted.

The connecting elements 50B are preferably made of elastic materials, such as rubber, and can enter the connecting holes 314B by compression and can be removed from the connecting holes 314B by applying an external force.

In this way, it is easy to disassemble and assemble the connecting bars 311B, and it is convenient to adjust the distance between the two adjacent hanging holders 31B and adjust the positions of the hanging holders 31B on the supporting frames 12B, thereby increasing the applicability, and thus it is convenient for hanging ornaments 60 of different sizes or lengths, preventing the ornaments 60 from overlapping with each other, and making the hanging ornaments 60 be elegantly and gracefully displayed.

Figure 9:
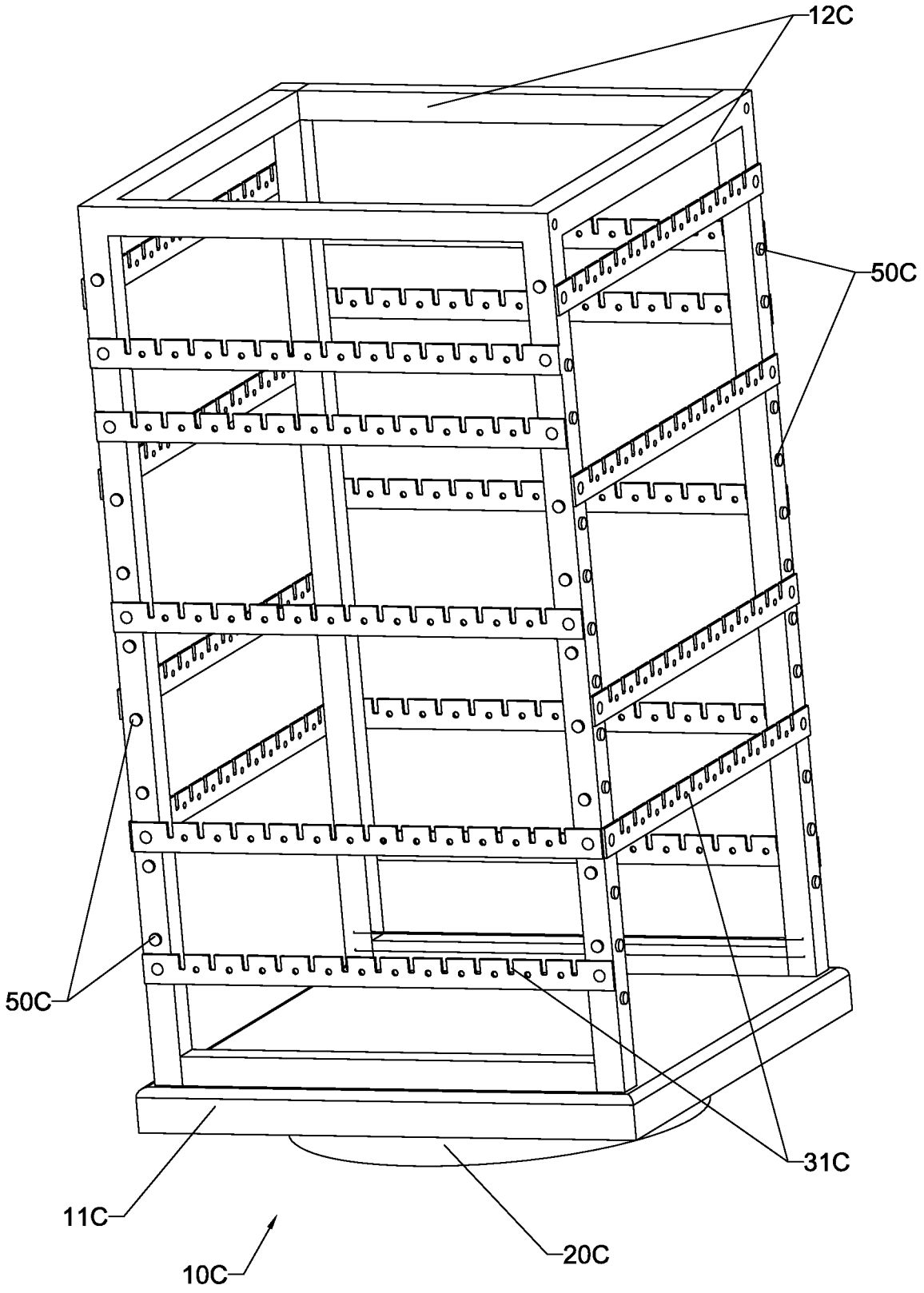
FIG. 9 is a perspective view of an ornament carousel holder according to a fourth preferred embodiment of the present invention.

Referring to FIG. 9, an ornament carousel holder according to a fourth preferred embodiment of the present invention is illustrated. In this embodiment, compared with the third embodiment mentioned above, the hanging meshes 32B are no longer provided, and all sides of the stand body 10C are provided with the hanging holders 31C, and the hanging holders 31C are detachably connected to the stand body 10C via the connecting elements 50C.

A plurality of hanging holders 31C is connected to the supporting frame 12C at intervals, thereby forming four hanging sides around the stand body 10C for hanging the ornaments 60.

Each hanging holder 31C is the same as the hanging holder 31B in the above embodiment, and the details are not repeated here. The distance between them can be changed by adjusting the relative position between the hanging holder 31C and the corresponding supporting frames 12C, thereby hanging ornaments 60 of different sizes and increasing applicability. Moreover, the hanging holders 31C can be provided at the outside of the supporting frame 12C, which is convenient for hanging accessories. The access passage 40C located at an inner side of the supporting frame 12C has a larger space, thereby making it easy to reach into the access passage 40C to operate the back of the hanging ornament. For example, when hanging the ear stud, it is convenient to allow a hand of the user to reach into the access passage 40C with a larger space to take the plug behind the ear stud.

The turntable 20C and the supporting base 11C are the same as in the above embodiment, and the details are not repeated here.

Referring to FIG. 10 to FIG. 18 of the drawings, an ornament carousel holder according to a fifth preferred embodiment of the present invention is illustrated. The ornament carousel holder comprises a stand body 10D, a turntable 20D, and a hanging assembly 30D. The stand body 10D is rotatably mounted to the turntable 20D and is able to be driven to rotate on the turntable 20D like a carousel, the hanging assembly 30D is arranged on the stand body 10D for hanging the ornaments 60 by a user in front of the ornament carousel holder.

An access passage 40D may be defined within the stand body 10D and the hanging assembly 30D, and a hand of the user is allowed to reach into the access passage 40D for cooperating with the other hand of the user at an outer side of the ornament carousel holder to place or remove the ornaments 60.

Referring to FIGS. 10 to 15 of the drawings, the turntable 20D comprises a supporting seat 21D and a rotation driving assembly 22D mounted on the supporting seat 21D. In this embodiment, a cross section of the supporting seat 21D has a circular shape and is arranged to be standing on a ground or a desktop, a first central hole 210D may be formed in the middle of the supporting seat 21D, so that the supporting seat 21D can be embodied as a supporting ring. The rotation driving assembly 22D comprises a bottom frame 221D and a top rotation disc 222D which is rotatably mounted on the bottom frame 221D. Accordingly, the rotation of the top rotation disc 222D on the bottom frame 221D can be achieved by any suitable manner. For example, the bottom frame 221D can be formed with a circular guiding groove, while the top rotation disc 222D can be formed with a rotating ring that is engaged with the circular guiding groove so that the top rotation disc 222D is able to rotate freely under the guiding of the circular guiding groove. Ball bearings may be provided in the circular guiding groove along a circumferential direction to reduce the friction so as to allow the top rotation disc 222D to smoothly rotate.

The stand body 10D is installed on the top rotation disc 222D of the turntable 20 and can be driven by an external force to rotate along with the top rotation disc 22D of the turntable 20. In other words, the bottom frame 221D and the supporting seat 21D are fixed, the top rotation disc 222D and the stand body 10D can be driven to rotate above the supporting seat 21D and the bottom frame 221D.

More specifically, the bottom frame 221D is connected and fixed to the supporting seat 11D by a plurality of first connecting members 23D each may comprise a fixing screw 231D and a fixing nut 232D, the fixing screw 231D penetrates through the supporting seat 21D and the bottom frame 221D and is engaged with the fixing nut 232D, so to fix the bottom frame 221D with the supporting seat 11D. As shown in FIGS. 13A to 15 of the drawings, four first connecting members 23D are used to fix the bottom frame 221D to the supporting seat 11D.

The rotation driving assembly 22D has a second central hole 220D penetrating through a center thereof and is aligned with the first central hole 210D of the supporting seat 21D so as to facilitate the assembling of the supporting seat 21D with the rotation driving assembly 22D and the assembling of the rotation driving assembly 22D with the stand body 10D.

According to this embodiment, the stand body 10D comprises a supporting base 11D and a plurality of supporting frames 12D such as two supporting frames 12D connected to the supporting base 11D above the supporting base 11D for supporting the hanging assembly 30. The supporting base 11D is mounted to the rotation driving assembly 22D of the turntable 20D, so as to rotate along with the top rotation disc 222D, so that the supporting frames 12D, the hanging assembly 30D can be also driven to rotate when the supporting base 11D is rotating.

The supporting base 11D can be fixed to the top rotation disc 222D by a plurality of second connecting members 24D such as two second connecting members 24D. The second central hole 220D is aligned with the first central hole 210D so that it facilitates the operator to reach his or her hand into the second central hole 220D to assemble the top rotation disc 222D with the supporting base 11D by the second connecting members 24D.

In this embodiment, the top rotation disc 222D has an inner edge portion 2221D that is spaced apart from the bottom frame 221D, the two second connecting members 24D penetrate through the inner edge portion 2221D of the top rotation disc 222D for fixing the inner edge portion 2221D of the top rotation disc 222D to the supporting base 11D of the stand body 10D. Each of the two second connecting members 24D may be embodied as a nail that is embedded into the supporting base 11D from a bottom of the supporting base 11D and the tip of the nail will not protrude from a top surface 111D of the supporting base 11D, so that the supporting base 11D has a smooth top surface 111D to enhance the aesthetic appearance thereof, and the smooth and flat top surface 111D can also be used for placing items such as the ornaments 60 or accessories.

Figure 15:
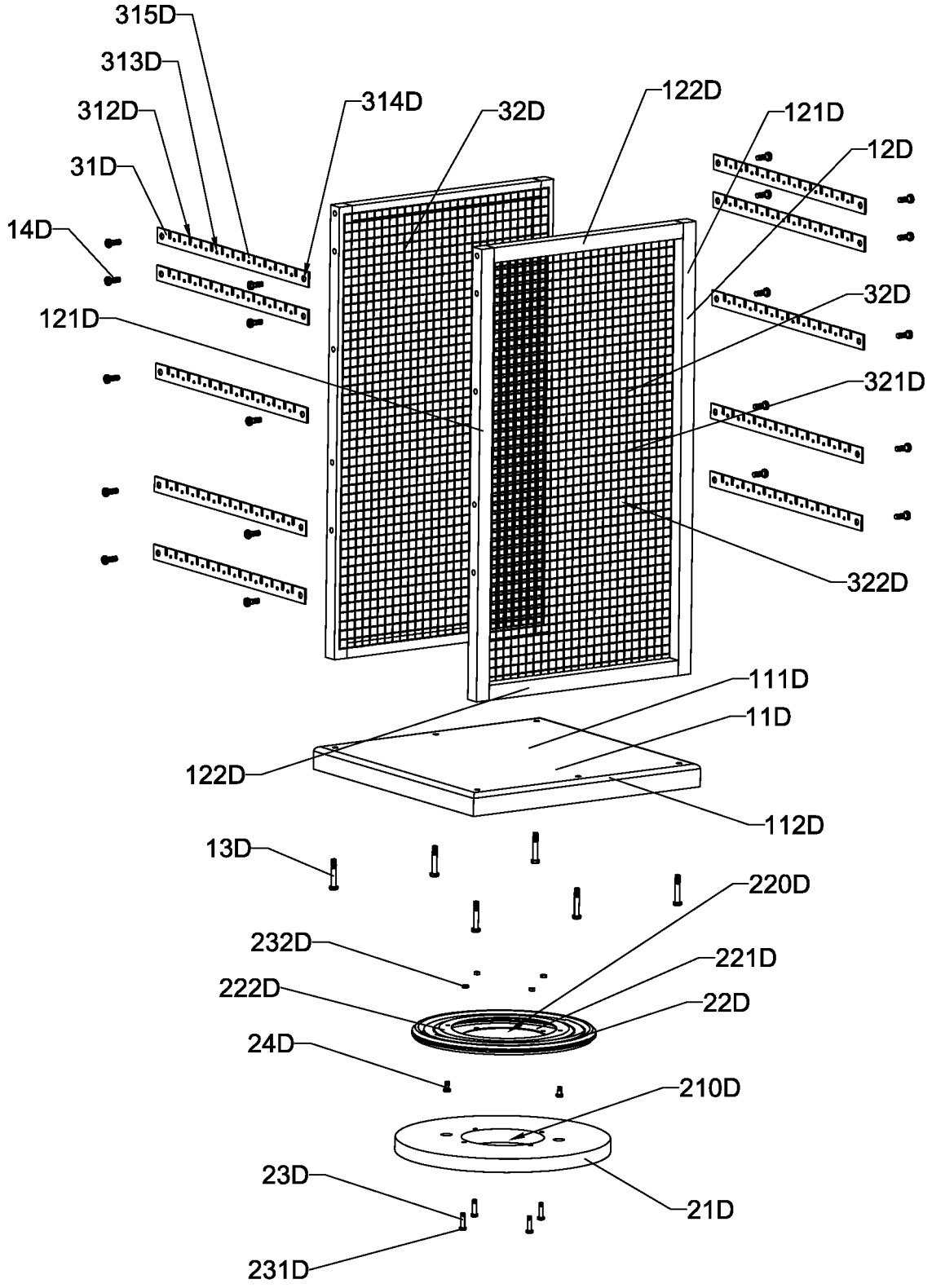
FIG. 15 is a further exploded view of the ornament carousel holder according to the above fifth preferred embodiment of the present invention.

The supporting base 11D in this embodiment can be a supporting board which has any suitable shape such as circular, square, rectangular, triangle and oval. As shown in FIG. 15 of the drawings, the supporting base 11D in this embodiment is a rectangular board.

Figure 12:
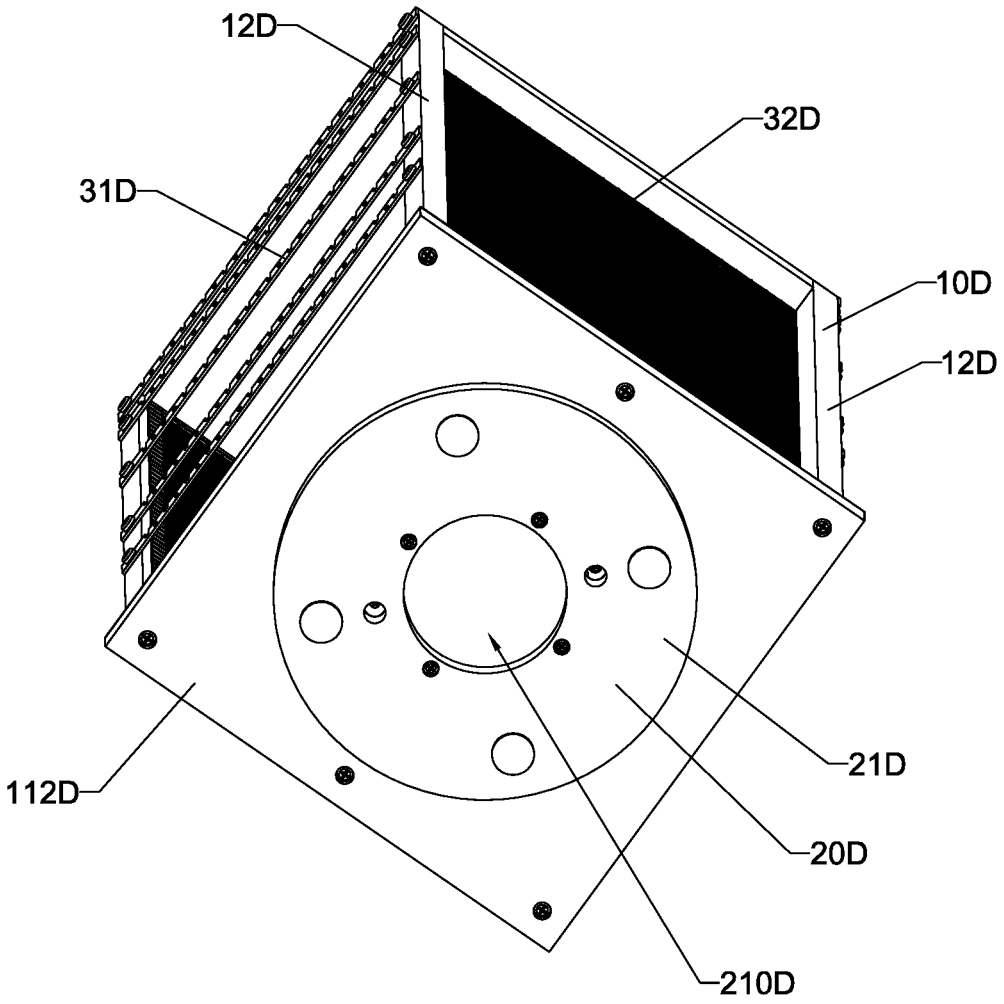
FIG. 12 is another perspective view illustrating a bottom of the ornament carousel holder according to the above fifth preferred embodiment of the present invention.
Figure 14A:
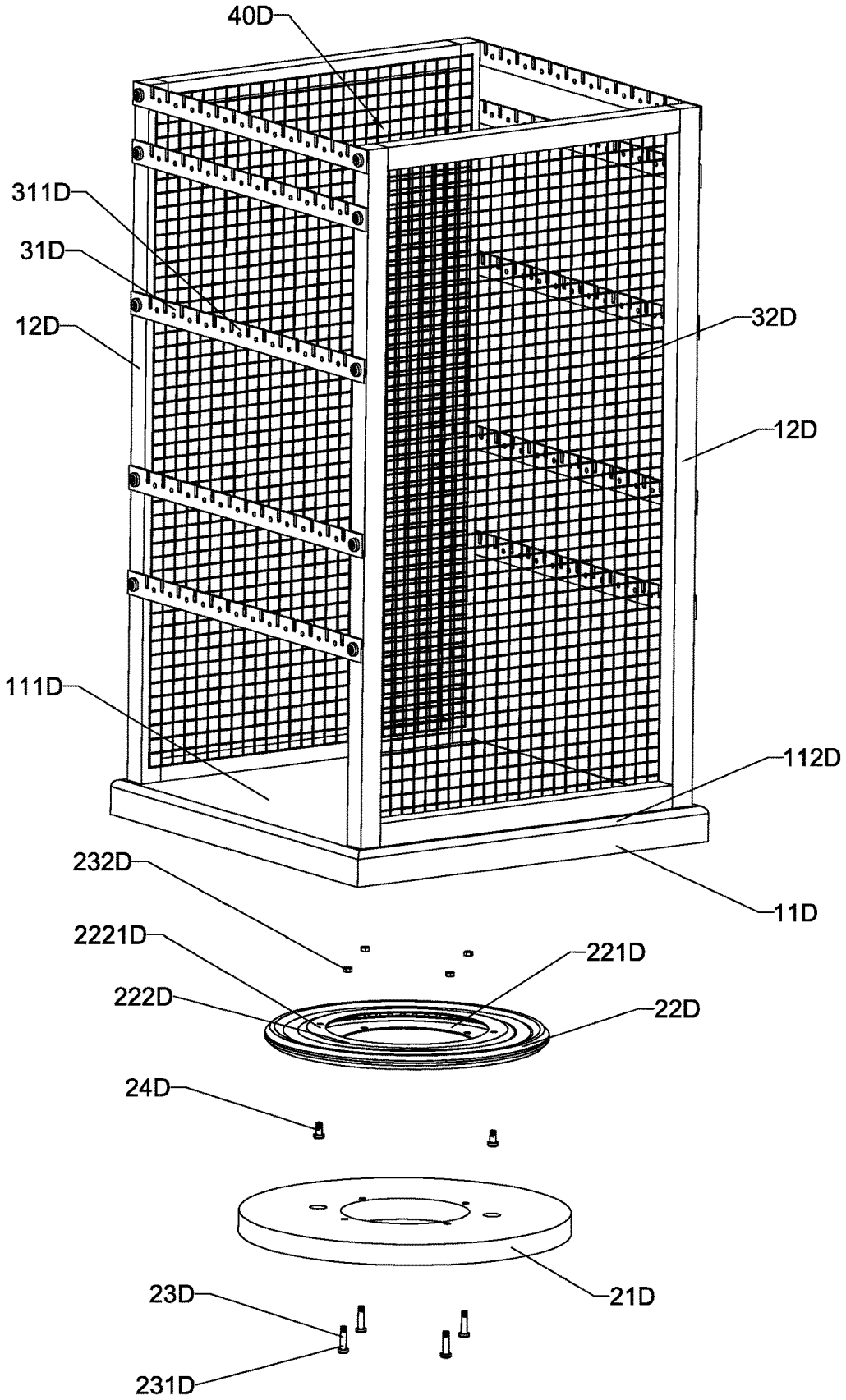
FIGS. 14A and 14B are respectively exploded views of the ornament carousel holder according to the above fifth preferred embodiment of the present invention, wherein an turntable is further exploded.
Figure 14B:
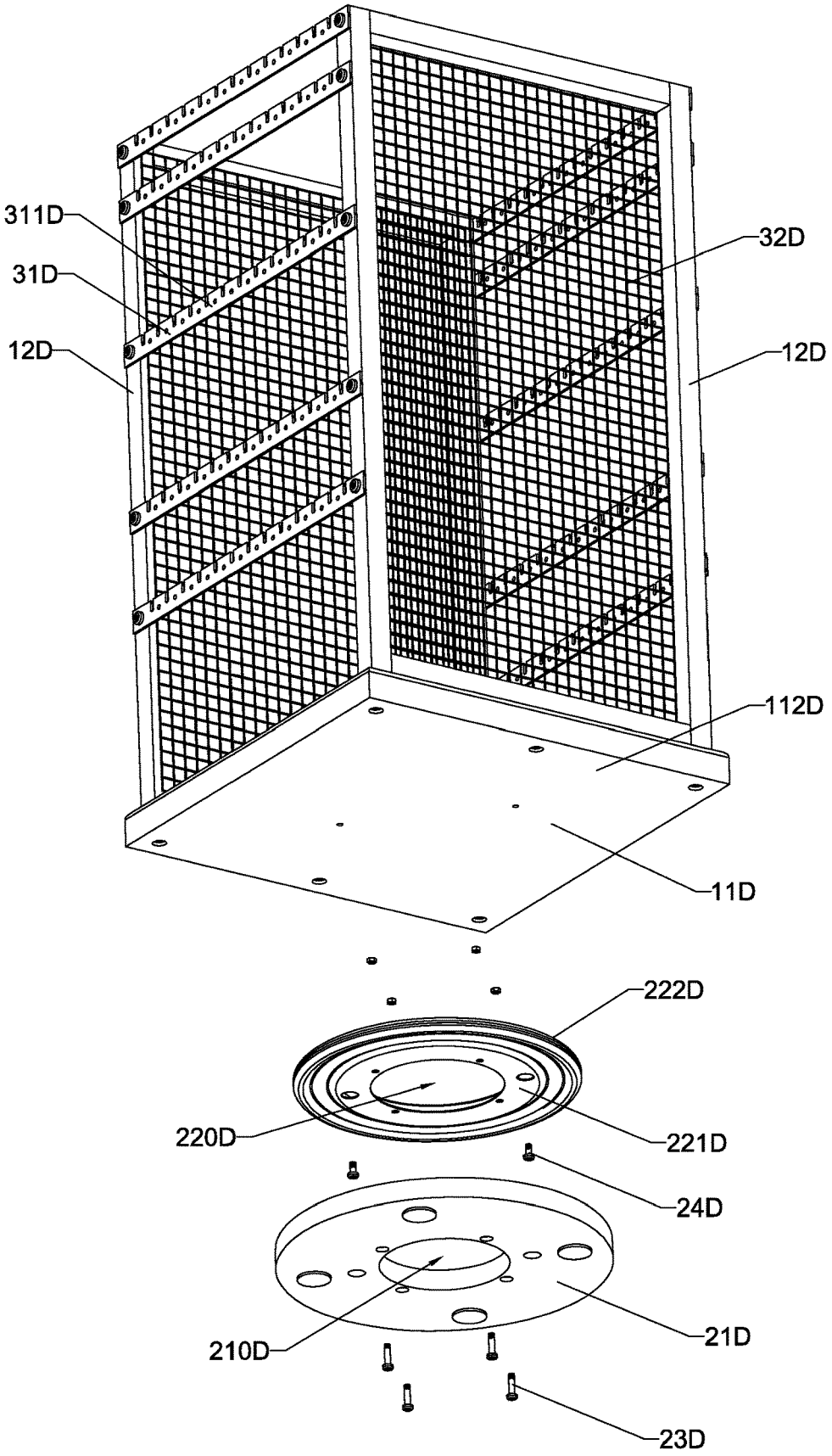
Figure 17:
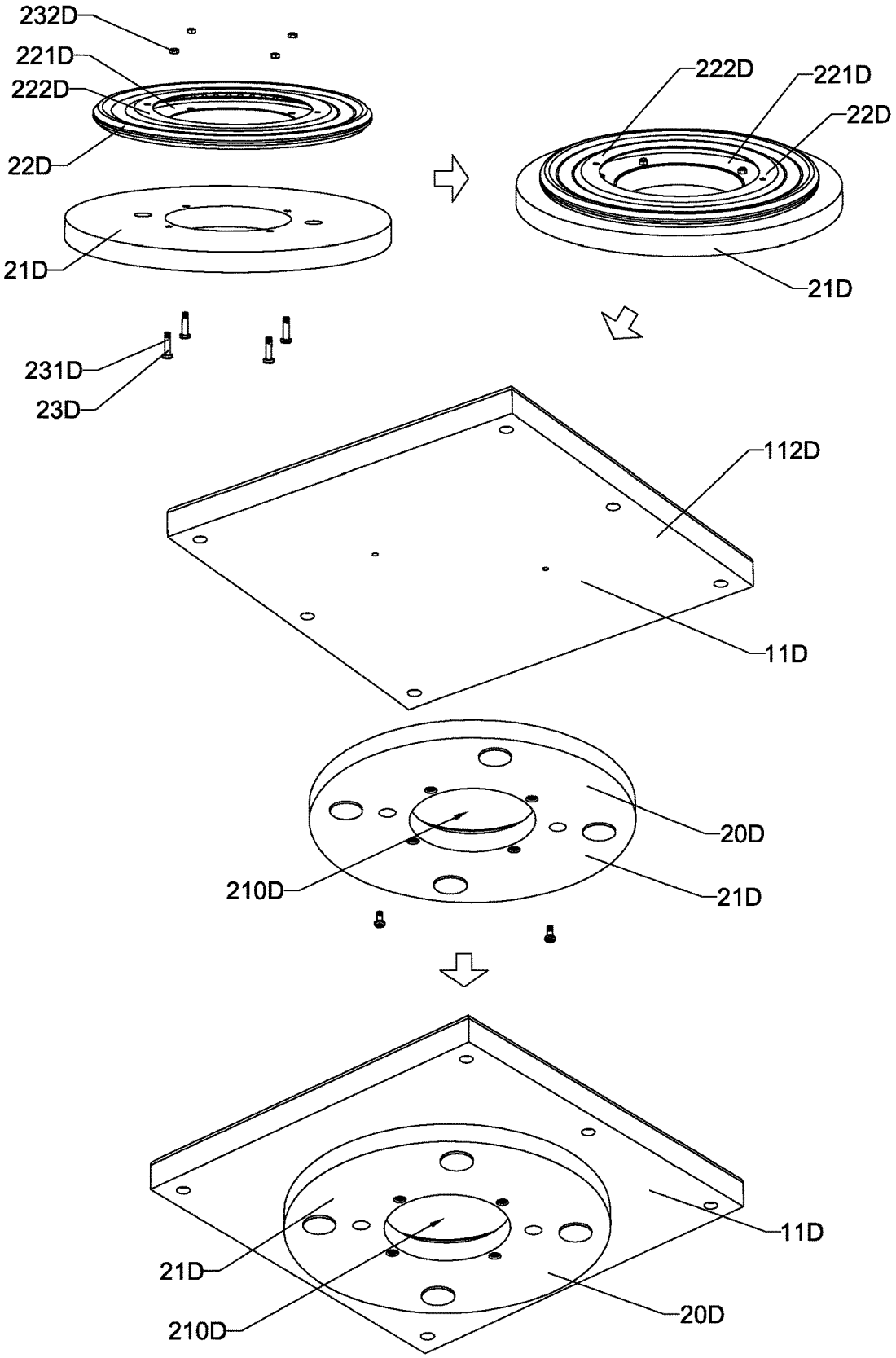
FIG. 17 is a schematic view illustrating a process for assembling the turntable and mounting a supporting base of a stand body to the turntable of the ornament carousel holder according to the above fifth preferred embodiment of the present invention.

Referring to FIGS. 12, 14 and 17 of the drawings, it is worth mentioning that the turntable 20D has a circular shape and a diameter of the turntable 20D is preferably smaller than a side length of the supporting base 11D, so that when the supporting base 11D is mounted on top of the turntable 20D, the turntable 20D is actually hidden under the supporting base 11D, so that the aesthetic appearance thereof is enhanced.

Accordingly, the turntable 20D is overlapped with a central area of the supporting base 11D at a bottom side of the supporting base 11D while a bottom surface of a peripheral edge area 112D thereof is exposed and not covered by the turntable 20D, so that the peripheral edge area 112D of the supporting base 11D can be utilized for allowing a plurality of third connecting members 13D to penetrate therethrough to fix the supporting base 11D with the supporting frames 12D.

As shown in FIG. 15 of the drawings, six third connecting members 13D are used to fix the supporting base 11D with the two supporting frames 12D. Four third connecting members 13D are provided at the four corners while two third connecting members 13D are provided on two side edges thereof.

Each of the supporting frames 12D can be embodied to have a suitable frame structure. In this embodiment, each supporting frame 12D is a rectangular frame comprising two vertical arms 121D and two horizontal arms 122D. In an alternative mode, each supporting frame 12D may comprise only the two vertical arms 121 and the two horizontal arms 122D may be omitted.

Figure 13A:
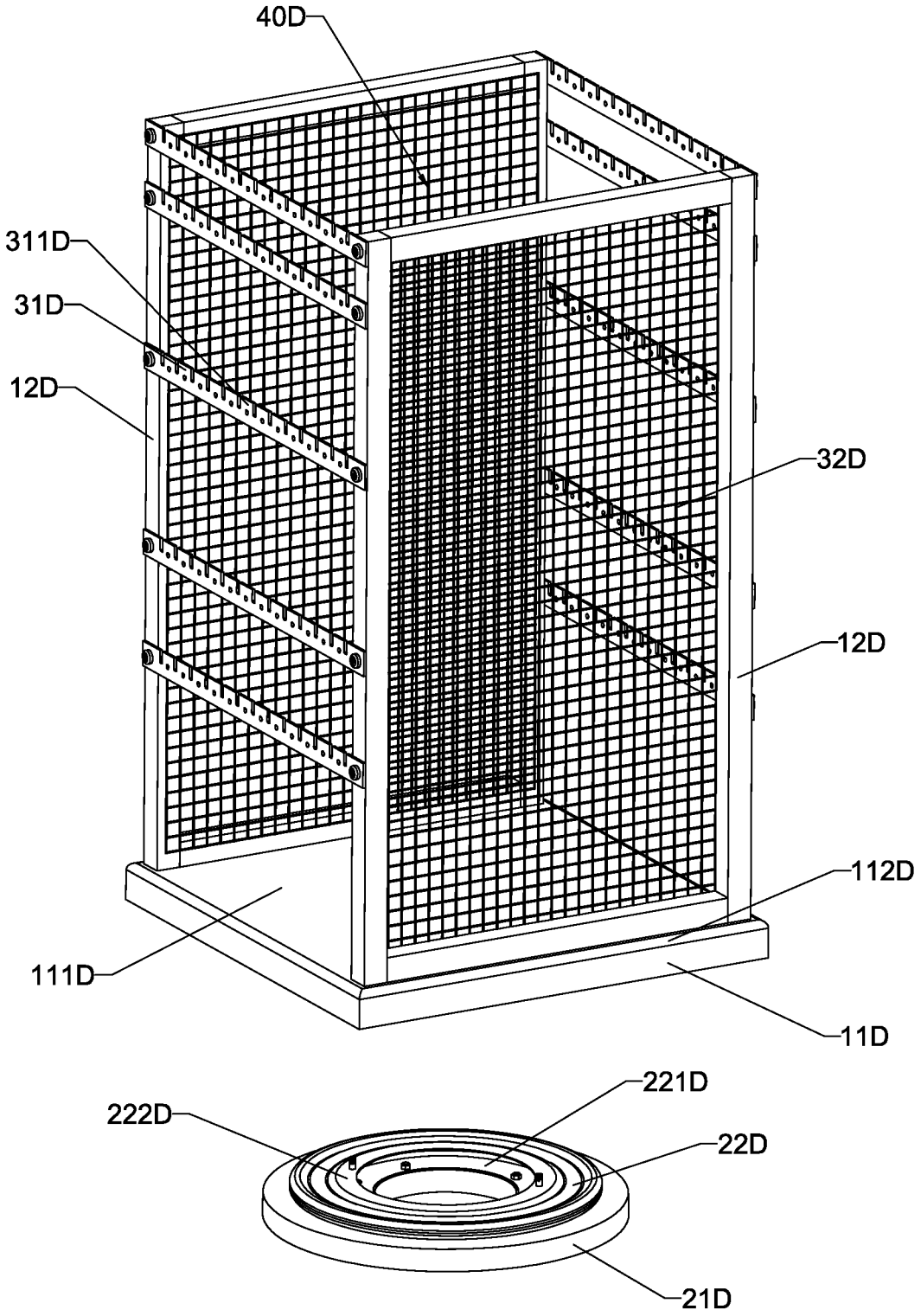
FIG. 13A is an exploded view of the ornament carousel holder according to the above fifth preferred embodiment of the present invention.
Figure 13B:
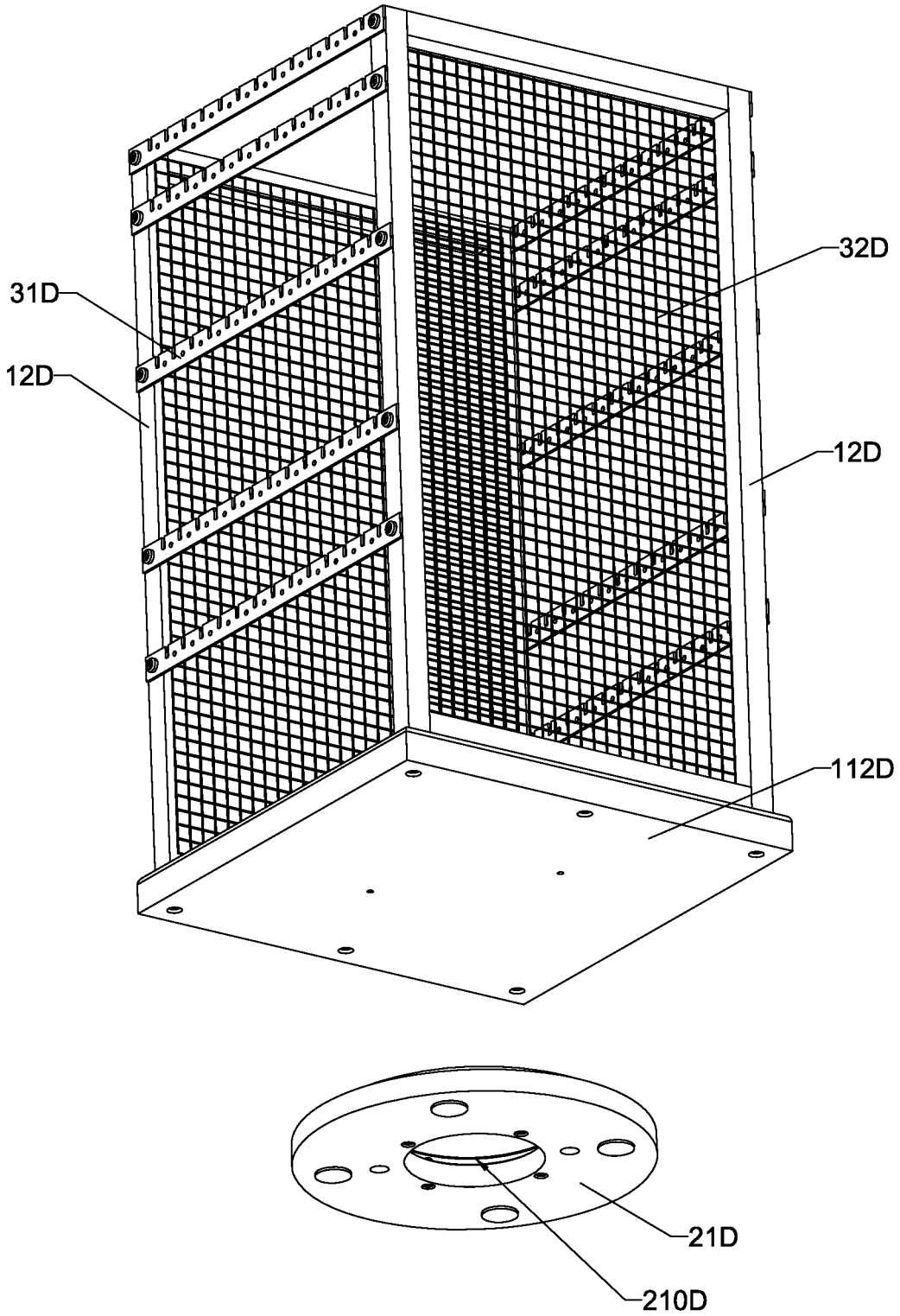
FIG. 13B is another exploded view of the ornament carousel holder according to the above fifth preferred embodiment of the present invention.

The two supporting frames 12D are spacedly arranged on the supporting base 20D. As shown in FIGS. 12 to 13B of the drawings, the two supporting frames 12D are arranged along the peripheral edge area 112D of the supporting base 11D. The hanging assembly 30 comprises a plurality of hanging holders 31D mounted to the two supporting frames 12D each extended between the two supporting frames 12D. Accordingly, the two supporting frames 12D are provided at two opposite sides of the stand body 10D, the plurality of hanging holders 31D is provided at the other two opposite sides of the stand body 10D. In other words, four sides of the access passage 40D are surrounded by the two supporting frames 12D and the plurality of hanging holders 31D.

As shown in FIGS. 10 to 15 the drawings, five hanging holders 31D are provided at a left side of the stand body 10D while another five hanging holders 31D are provided at a right side of the stand body 10D. Two adjacent hanging holders 31D are spaced apart from each other with an interval. A plurality of fourth connecting members 14D is used to fix the two ends of each hanging holders 31D to the two supporting frames 12D. Alternatively, the plurality of hanging holders 31D can be detachably mounted to the two supporting frames 12D, so that the intervals and spacing between the two adjacent hanging holders 31D can be adjusted according to the user's preference.

Figure 10:
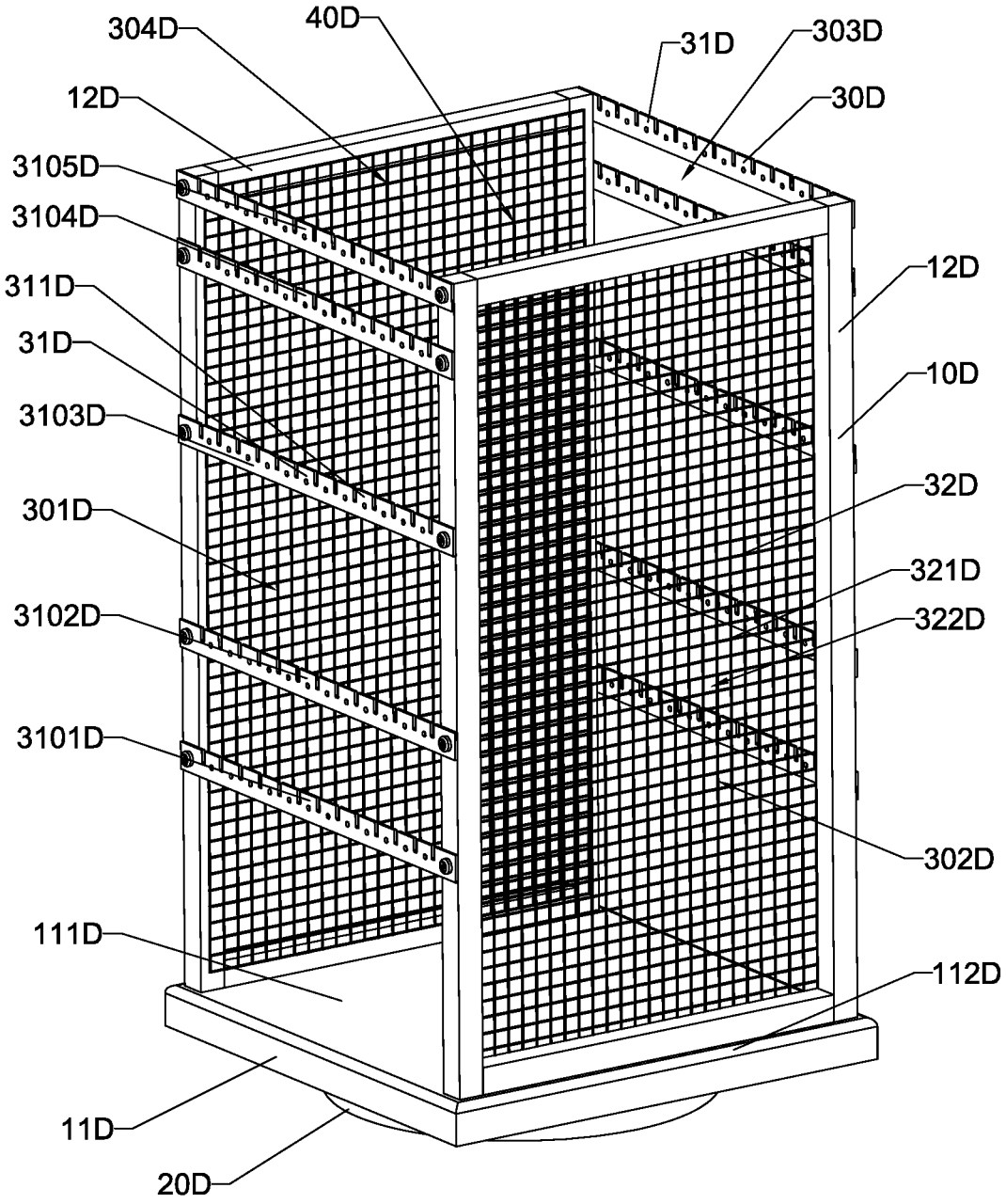
FIG. 10 is a perspective view of an ornament carousel holder according to a fifth preferred embodiment of the present invention.
Figure 11:
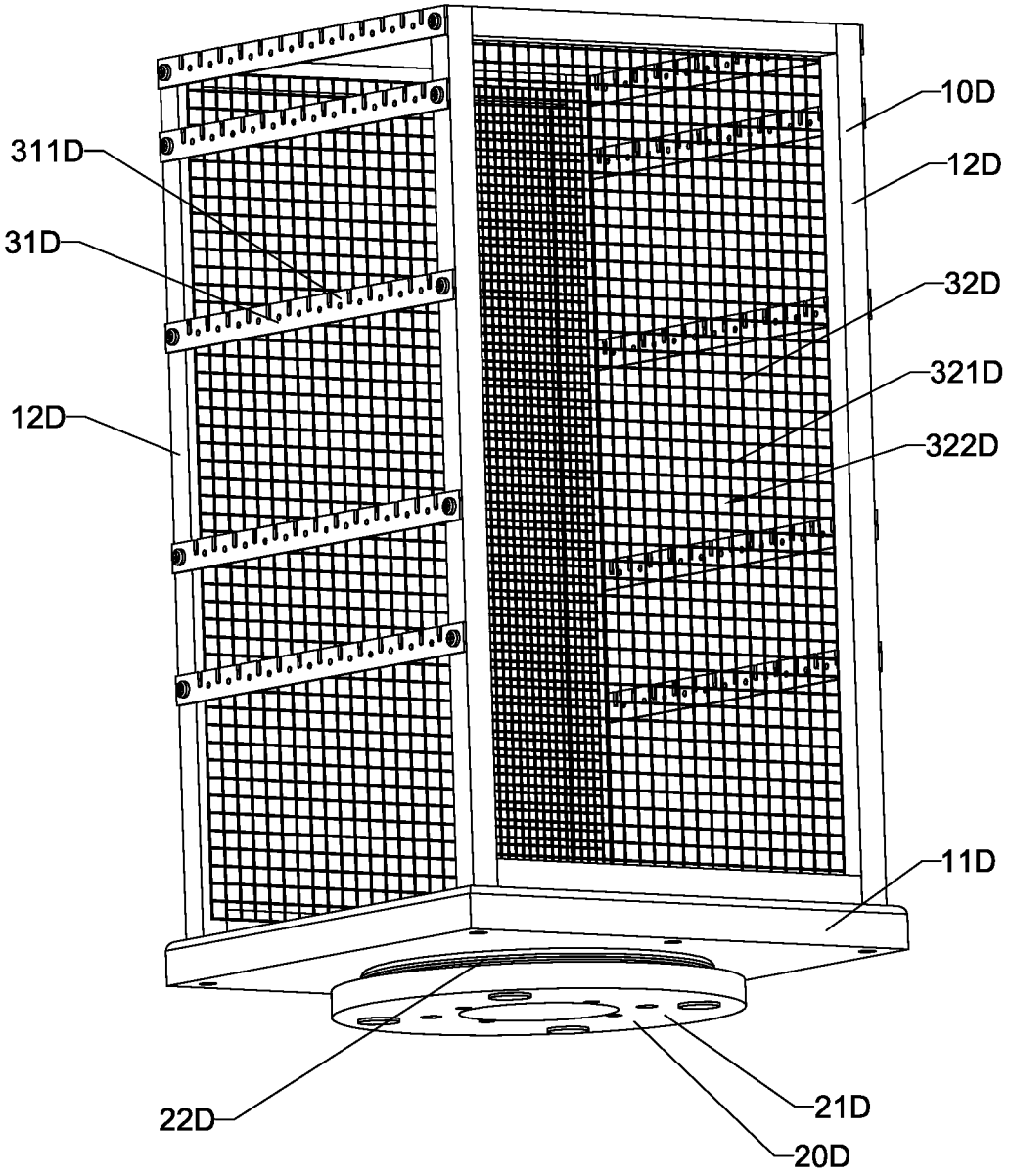
FIG. 11 is another perspective view of the ornament carousel holder according to the above fifth preferred embodiment of the present invention.

In this embodiment, as an example, as shown in FIG. 10, the five hanging holders 31D at one side of the stand body 10D, from bottom to top, comprise a first hanging holder 3101D, a second hanging holder 3102D, a third hanging holder 3103D, a fourth hanging holder 3104D and a fifth hanging holder 3105D. The first hanging holder 3101D is connected between the two supporting frames 12D at a height of 3.15 inches above the supporting base 11D, an interval between the first hanging holder 3101D and the second hanging holder 3102D is 1.37 inches, an interval between the second hanging holder 3102D and the third hanging holder 3103D is 2.56 inches, an interval between the third hanging holder 3103D and the fourth hanging holder 3104D is 2.17 inches, an interval between the fourth hanging holder 3104D and the fifth hanging holder 3102D which is provided on the top side of the stand body 10D is 0.6 inches. A person of ordinary skilled in the art should understand that the values of the above height and intervals are only examples and are not intended to be limiting.

In this embodiment, each hanging holder 31D comprises a connecting bar 311D having a plurality of hanging grooves 312D, a plurality of hanging holes 313D and two connecting holes 314D. For example, the connecting bar 311D has twelve hanging holes 313D and thirteen hanging grooves 312D. A protrusion 315D is formed between two adjacent hanging grooves 312D.

In addition, the hanging assembly 30D further comprises a plurality of hanging meshes 32D such as to two hanging meshes 32D each is a wire grid. Each of the hanging meshes 32D is mounted within the corresponding rectangular supporting frame 12D and comprises a plurality of mesh wires 321D which are crossly interconnected to form a plurality of mesh holes 322D for hanging the ornaments 60.

Accordingly, as illustrated in FIG. 10, the stand body 10D and the hanging assembly 30D form four ornament displaying sides of the ornament carousel holder. The plurality of hanging holders 31D form a first ornament displaying side 301D, and a third ornament displaying side 303D. The two supporting frames 20D with the two hanging meshes 32D form a second ornament displaying side 302D and a fourth ornament displaying side 304D. The first ornament displaying side 301D and the third ornament displaying side 303D are two opposite sides while the second ornament displaying side 302D and the fourth ornament displaying side 304D are the other two opposite sides of the ornament carousel holder.

Figure 16:
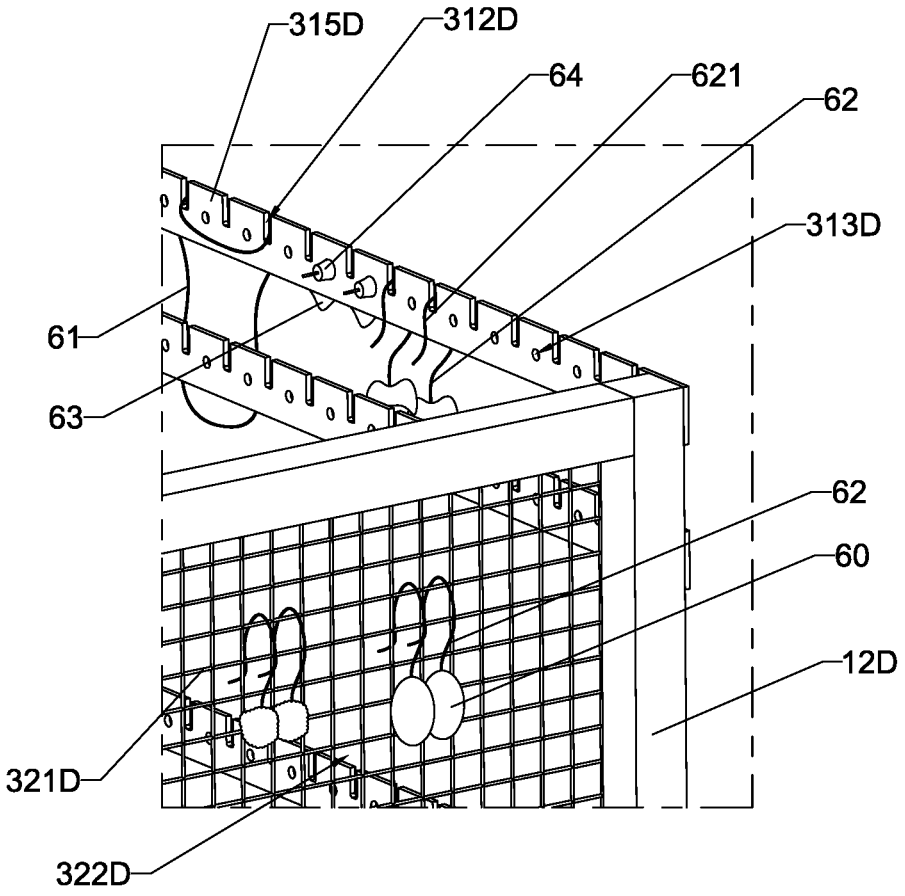
FIG. 16 is a schematic view illustrating the ornament carousel holder being used to hang ornaments according to the above fifth preferred embodiment of the present invention.

As shown in FIG. 16 of the drawings, one of the ornaments 60 can be a necklace 61 that is hang at two hanging grooves 312D and is retained by one or more protrusions 315D, one of the ornaments 60 can be an earring 62 with a hook portion 621 that is hooked at the hanging hole 313D. Particularly, one of the ornaments 60 can be an ear stud 63 which is provided with a plug accessory 64 and can be hung at the hanging hole 313D, one hand of the user may reach into the access passage 40D to operate on the plug accessory 64 and the other hand of the user may operate on the ear stud 63, so that the placing and removing of the ear stud 63 can be convenient.

According to this preferred embodiment of the present invention, the overall structure of the ornament carousel holder has a stable structure that is not able to tip over and the ornament carousel holder is a superior furniture or elegant rack of a selling or exhibition store. It is worth mentioning that the ornament carousel holder can be made of suitable material which can be rigid material such as wood and metal. Preferably, the supporting seat 21D of the turntable 20D is made of wood so as to function as a stable anchor and supporter at the bottom of the ornament carousel holder, the rotation driving assembly 22D is made of metal such as stainless steel and sandwiched between the supporting seat 21D and the supporting base 11D of the stand body 10D. The stand body 10D of the ornament carousel holder is also preferred to be made of wood, each of the hanging holders can be made of rigid material such as wood or metal so as to stably connect the two supporting frames 12D and to enhance the connection strength of the stand body 10D and the hanging assembly 30.

According to this embodiment, a weight of a lower part of the ornament carousel holder comprising the turntable 20D and the supporting base 11D at a bottom of the ornament carousel holder is larger than a weight of an upper part of the ornament carousel holder which comprises the supporting frames 12D and the hanging assembly 30D, so that the center of gravity of the whole ornament carousel holder is steady and maintained at the lower part of the ornament carousel holder, so that the ornament carousel holder is not likely to tip over. For example, in this embodiment, the lower part of the ornament carousel holder comprising the turntable 20D and the supporting base 11D is 480 g, the upper part of the ornament carousel holder comprising the supporting frames 12D and the hanging assembly 30D is 400 g. A person of ordinary skilled in the art should understand the weight values are only examples and are not limiting.

It is worth mentioning that the ornament carousel holder of the present invention makes it easy to display and quick to find ornaments 60, especially earrings. The enlarged access passage 40D in the center makes it easy to reach earring backs and take earrings quickly. Additionally, the connecting bar 311D which are embodied as iron bars are securely fixed with screws and won't slide when the user touches the earrings.

The ornament carousel holder of the present invention allow the user to store all of his or her earrings in one place because of its high holding capacity. For example, each connecting bar 311D can hold at least 60 pairs of earrings, each hanging mesh 32D can also hold a large number of earrings, so that a user can be able to store a total of at least 120 pairs of earrings on this ornament carousel holder.

The combination of hanging holders 31D and the hanging meshes 32D gives the user flexibility in how he or she wants to display the earrings. The user can place earrings anywhere on the hanging meshes 32D which are perfect for long dangling earrings, while the hanging holders 31D are perfect for stud earrings & hoop earrings.

Figure 18:
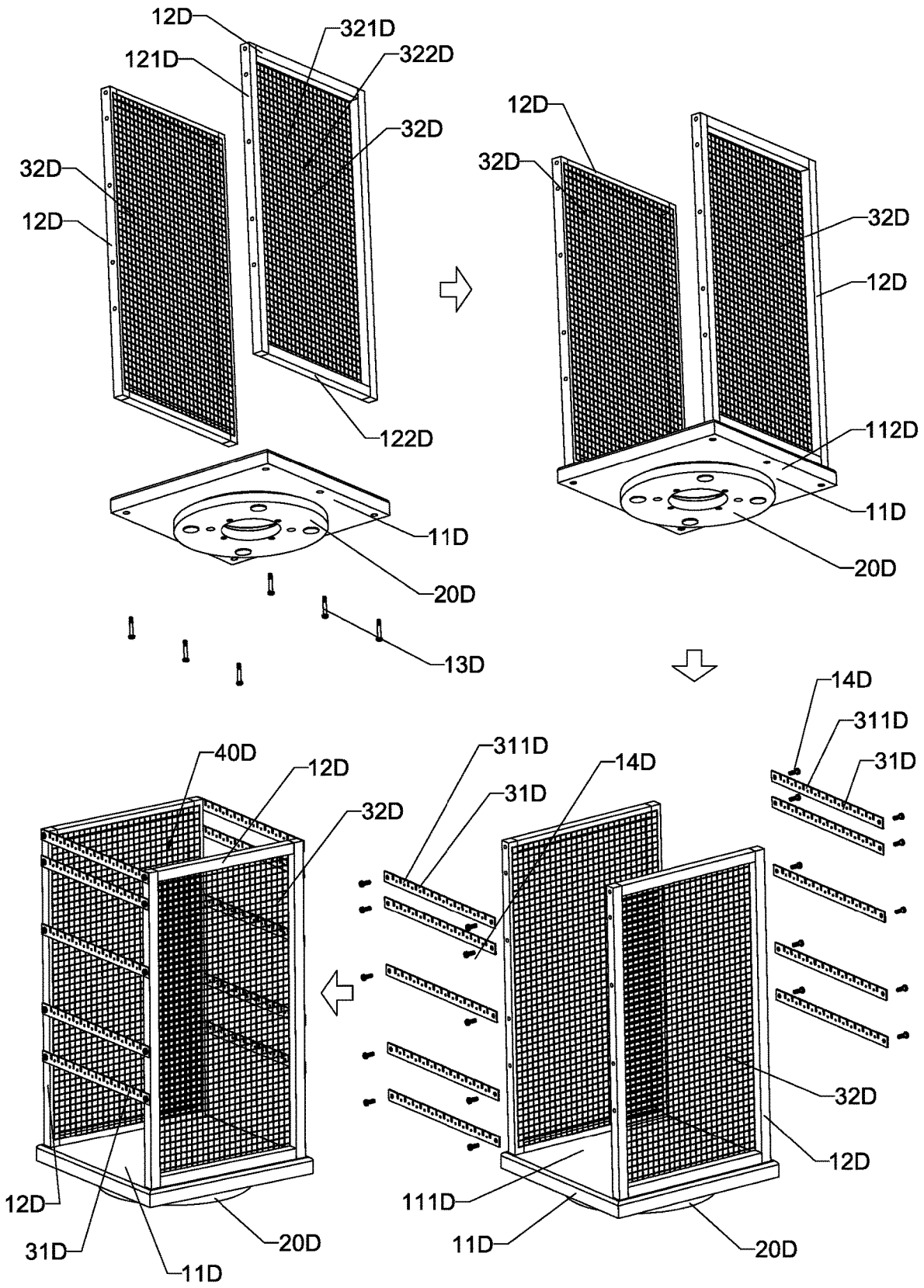
FIG. 18 is a schematic view illustrating a process for assembling two supporting frame and a hanging assembly on the supporting base of the ornament carousel holder according to the above fifth preferred embodiment of the present invention.

Referring to FIG. 17 to FIG. 18 of the drawings, a method for assembling the ornament carousel holder according to the fifth preferred embodiment of the present invention is illustrated. The method comprises a step of assembling the turntable 20D, a method of mounting the stand body 10D on the turntable 20D, and a step of installing the hanging assembly 30D.

More specifically, in the step of assembling the turntable 20D, the rotation driving assembly 22D is placed on the supporting seat 21D and the plurality of first connecting members 23D is used to mount the bottom frame 221D of the rotation driving assembly 22D with the supporting seat 21D.

In the step of mounting the stand body 10D on the turntable 20D, the supporting base 11D is mounted to the top rotation disc 222D of the rotation driving assembly 22D by the plurality of second connecting members 24D. And then the plurality of third connecting members 13D are penetrating through the peripheral edge portion of the supporting base 11D which is not covered by the turntable 20D to mount the supporting base 11D with the two supporting frames 12D each can be already installed with the hanging mesh 32D.

In the step of installing the hanging assembly 30D, the plurality of connecting bars 311D of the hanging holders 31D are mounted to the supporting frames by the plurality of fourth connecting members 14D and are spacedly and parallelly extended between the two supporting frames 12D and arranged for hanging the ornaments 60 while enhancing the structural strength of the ornament carousel holder.

Those skilled in the art should understand that the above description and the embodiments shown in the drawings are only examples and do not limit the present invention. The purpose of the present invention has been fully and effectively achieved. The functions and structural principles of the present invention have been demonstrated and described in the embodiments. Without departing from the principles of the present invention, the embodiments of the present invention can be modified or changed in any way.

What is claimed is:

1. An ornament carousel holder, comprising:

a stand body which comprises a supporting base and two supporting frames which are spacedly installed on said supporting base;

a turntable, wherein said supporting base of said stand body is mounted on said turntable and is capable of being driven to rotate on said turntable; and a hanging assembly connected to said stand body for hanging ornaments, wherein said hanging assembly comprises a plurality of hanging holders which are spacedly and parallelly extended between two said supporting frames and two hanging meshes mounted within two said supporting frames respectively, wherein each of said plurality of hanging holders comprises a connecting bar and has a plurality of hanging grooves indented at said connecting bar and a plurality of hanging holes formed in said connecting bar, wherein each of said plurality of hanging holes is formed between two adjacent said hanging grooves, wherein each of said two hanging meshes comprises a plurality of mesh wires which is crossly interconnected to form a plurality of mesh holes for hanging the ornaments, wherein said stand body and said hanging assembly are connected to form four ornament hanging sides, wherein an access passage is defined within said four ornament hanging sides between said two supporting frames, said plurality of hanging holders and said two hanging meshes to allow a hand of a user to access an inner side of said hanging assembly from a top of said stand body.

2. The ornament carousel holder according to claim 1, wherein said turntable comprises a supporting seat and a rotation driving assembly mounted on said supporting seat, wherein said rotation driving assembly comprises a bottom frame fixed to said supporting seat and a top rotation disc rotatably mounted to said bottom frame, wherein said supporting base of said stand body is mounted on said top rotation disc so as to rotate along with said top rotation disc.

3. The ornament carousel holder according to claim 2, wherein said supporting seat has a first central hole, said rotation driving assembly has a second central hole to be aligned with said first central hole.

4. The ornament carousel holder according to claim 2, further comprising a plurality of second connecting members connecting said top rotation disc of said rotation driving assembly to said supporting base without protruding from a top surface of said supporting base, so as to provide a smooth top surface of said supporting base, wherein said supporting base is allowed to rotate 360°.

5. The ornament carousel holder according to claim 2, wherein said turntable is mounted at a bottom of said supporting base in such a manner that a peripheral edge portion of said supporting base is outwardly protruded from said turntable, so as to allow said turntable to be hidden under said supporting base.

6. The ornament carousel holder according to claim 5, wherein said ornament carousel holder comprises a plurality of third connecting members mounting said supporting base with two said supporting frames by penetrating said peripheral edge portion of said supporting base.

7. The ornament carousel holder according to claim 2, wherein said stand body is made of wood, said supporting seat is made of wood, and said rotation driving assembly is made of metal.

8. The ornament carousel holder according to claim 7, wherein said plurality of hanging holders is made of metal.

9. The ornament carousel holder according to claim 7, wherein a weight of said turntable and said supporting base of said stand body is larger than a weight of two said supporting frames and said hanging assembly.

10. The ornament carousel holder according to claim 7, wherein said turntable is circular and said supporting base is rectangular.

* * * * *